US006489069B1

(12) United States Patent
Itami et al.

(10) Patent No.: US 6,489,069 B1
(45) **Date of Patent: *Dec. 3, 2002**

(54) ELECTROPHOTOGRAPHIC IMAGE CARRIER AND IMAGE FORMING APPARATUS, IMAGE FORMING METHOD AND PROCESSING CARTRIDGE USING IT

(75) Inventors: Akihiko Itami, Hachioji (JP); Takeo Oshiba, Hachioji (JP); Tomoo Sakimura, Hachioji (JP); Yohko Kitahara, Hachioji (JP); Masahiko Kurachi, Hachioji (JP); Kazuhisa Shida, Hachioji (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/501,100

(22) Filed: Feb. 9, 2000

(30) Foreign Application Priority Data

| | | |
|---|---|---|
| Feb. 15, 1999 | (JP) | 11-035811 |
| Feb. 22, 1999 | (JP) | 11-043292 |
| Jul. 14, 1999 | (JP) | 11-200135 |

(51) Int. Cl.[7] ..... G03G 5/043; G03G 5/147

(52) U.S. Cl. ..... 430/58.2; 430/66; 430/67; 430/970; 399/96; 399/116; 399/159

(58) Field of Search ..... 430/56, 66, 67, 430/58.2, 96, 970, 59.6, 58.7; 399/96, 97, 116, 159

(56) References Cited

U.S. PATENT DOCUMENTS

| | | | | | |
|---|---|---|---|---|---|
| 4,898,799 | A | * | 2/1990 | Fujimaki et al. | 430/78 |
| 4,943,501 | A | * | 7/1990 | Kinoshita et al. | 430/66 |
| 4,952,470 | A | * | 8/1990 | Tamaki et al. | 430/970 |
| 5,130,751 | A | * | 7/1992 | Sato et al. | 399/96 |
| 5,292,603 | A | * | 3/1994 | Sakai et al. | 430/66 |
| 5,530,523 | A | * | 6/1996 | Kawabata | 399/97 |
| 5,721,081 | A | * | 2/1998 | Takagi et al. | 430/970 |
| 5,912,098 | A | * | 6/1999 | Tanaka et al. | 430/67 |
| 6,051,357 | A | * | 4/2000 | Matsui et al. | 430/65 |
| 6,143,452 | A | * | 11/2000 | Sakimura et al. | 430/58.2 |
| 6,265,122 | B1 | * | 7/2001 | Itami et al. | 430/59.4 |

FOREIGN PATENT DOCUMENTS

| | | | | |
|---|---|---|---|---|
| EP | 0771805 | | 5/1997 | |
| EP | 0772091 | | 5/1997 | |
| EP | 0838729 | | 4/1998 | |
| JP | 2-87150 | * | 3/1990 | 430/970 |
| JP | 9190004 | | 7/1997 | |
| JP | 9319130 | | 12/1997 | |
| JP | 10-282697 | * | 10/1998 | |

OTHER PUBLICATIONS

Derwent Abstract Acc. No. 90–142371/19, describing JP 2–87150, attached to JP 2–87150, 1990.*
Japanese Patent Office Machine–Assisted Translation of JP 10–282697, Oct. 1998.*
US Patent & Trademark English–Language Translation of JP 2–87150 (pub. Mar. 1999).*
Derwent Machine–Assisted Translation of JP 10–282697 (pub. Oct. 1998).*
European Search Report EP 00 10 2246.
Patent Abstracts of Japan, Publication # 04308852, Publication date: Oct. 30, 1992 (1 page).
Patent Abstracts of Japan, Publication # 05181299, Publication date: Jul. 23, 1993 (1 page).
Patent Abstracts of Japan, Publication # 04024643, Publication date: Jan. 28, 1992 (1 page).
Patent Abstracts of Japan, Publication # 07013467, Publication date: Jan. 17, 1995 (1 page).
Patent Abstracts of Japan, Publication # 06019153, Publication date: Jan. 28, 1994.

* cited by examiner

*Primary Examiner*—Janis L. Dote
(74) *Attorney, Agent, or Firm*—Bierman, Muserlian and Lucas

(57) ABSTRACT

An electrophotographic image carrier is disclosed. The image carrier has a photoreceptor made from a photoreceptive layer and a resin layer. The resin layer is made of a siloxane resin having a cross-linked structure, and contains an anti-oxidant.

19 Claims, 2 Drawing Sheets

ELECTROPHOTOGRAPHIC IMAGE CARRIER AND IMAGE FORMING APPARATUS, IMAGE FORMING METHOD AND PROCESSING CARTRIDGE USING IT

FIELD OF THE INVENTION

This invention relates to an electrophotographic image carrier and an image forming apparatus, an image forming method and a processing cartridge using the image carrier.

BACKGROUND OF THE INVENTION

Recently, an electrophotographic image forming method is popularly used for writing digital processed data, in which an organic photoreceptor is exposed to light doted image wise to form a static latent image on the image carrier comprising a photoreceptor and an image is formed by a reversal development.

It is required to the electrophotographic image carrier comprising the photoreceptor to be used in such the method that the photoreceptor is stable for a prolonged period of time of use and is able to correspond to writing of a high-resolution image. Usually, an organic photoreceptor, also referred to OPC, is an essential technology for a process requiring a high image quality since the organic photoreceptor can be selected from a great choice of materials, compared with an inorganic photoreceptor. Accordingly, the organic photoreceptor can easily be corresponded to various kinds of light source and is excellent in the stability of charged potential.

On the other hand, the organic photoreceptor is required to be improved in the durability thereof since the organic photoreceptor is low in the mechanical strength and a defect caused by a wearing or a damage. The use of a protective layer formed by cross-linked a siloxane resin, which is excellent in the mechanical strength, is noted as a technology by which the resistivity of the organic photoreceptor to the problems of damage and wearing can be raised.

Various trial have been carried out to solve such the problems. For example, a technology in which a condensation product of an organic silicon polymer and colloidal silica is contained in the surface layer is disclosed in Japanese Patent Publication Open to Public Inspection No. 9-319130.

Recently, as described in Japanese Patent Publication Open to public Inspection (JP O.P.I.) 9-190004, a photoreceptor is developed which has a resin layer containing a siloxane resin having a charge transportable structural unit. Such the protective layer is superior in the mechanical strength and the electric property, and the drawback of the mechanical strength of the organic photoreceptor can be considerably improved thereby. However, the effect of such the layer is insufficient yet in the durability and the image quality.

Besides, it has been known that the charge transporting substance in the properties of the photoreceptive layer is deteriorated by an oxidant gas such as ozone or $NO_x$ formed by an electrode for charging, transferring or separating. The oxidation of the photoreceptor causes lowering in the charging property and the light sensitivity, consequently a fault in the image such as fogging or lowering in the image density is occurred. However, the deterioration is apparently inhibited in an usual photoreceptor since the photoreceptive layer is suitably worn and the extreme surface, which is mostly deteriorated, is suitably worn and the deteriorated substance and the contamination substance on the surface is removed.

In contrast, in the photoreceptor having the resin layer containing the siloxane resin having the charge transportable structural unit, the mechanical strength and the electrophotographic property of the photoreceptor can be raised by the strength of the siloxane resin and the presence of the charge transportable unit and an advantage that the wearing amount of the photoreceptor is extremely reduced. However, the reduced wearing amount of the photoreceptor makes difficult to remove the effect of the contamination substance formed by the effect of the oxidant gas such as ozone or $NO_x$. Accordingly, it is strongly required to inhibit the deterioration under the condition in which the wearing is difficultly occurred.

SUMMARY OF THE INVENTION

It is pointed out that the problems of deterioration in the stability of charged potential of the photoreceptor and the image quality are caused by accumulation of the deteriorated substance formed by the oxidant gas such as ozone and $NO_x$ in a prolonged period of time since the siloxane resin having a cross-linked structure excellent in the surface strength is lowered in the wearing amount. The invention is carried out to solve such the problems.

As a result of the studying by the inventors, it is a problem of the cross-linked layer of organic silicon that the layer is easily influenced by the absorbed moisture under a high humid condition since a not reacted hydrolyzable group or a silanol group tends to be remained on the layer surface. When a large amount of not reacted group exists, absorption of water molecules and formation of a product of discharge in the charging process tend to occur under a high humid condition. Consequently, the surface electric resistivity is lowered and a problem such as image flowing is caused.

The above-mentioned phenomena are considerably occurred at a portion near the charging electrode when the image carrying drum is stopped. For example, the image flowing cannot be sufficiently inhibited at the portion under the charging electrode by blowing exhausted air or a heating device arranged at a portion near the image carrying drum. It is considered that the damaging substance such as active oxygen formed in the operating period is remained around the charging electrode and affects to the photoreceptor coated on the stopped image carrier. Accordingly, the surface of the image carrier cannot be uniformly heated by usual blowing of the exhaust air or by the separated heating device arrange at near the image carrier, and effect of such the heating means may be insufficient to prevent the absorption of water molecules under the high humid condition.

SUMMARY OF THE INVENTION

The object of the invention is to provide an electrophotographic image carrier comprising a photoreceptor, in which the effects of the resin layer containing a siloxane resin having a cross-linked structure is maintained during a prolonged period of time, and which has a good charging property, a high sensitivity and a high image quality, and the charged potential thereof is stable in the course of use for a prolonged period of time, and to provide an image forming apparatus, an image forming method and a processing cartridge using the image carrier.

The another object of the invention is to provide an electrophotographic image carrier which has a good charging ability, a high sensitivity and a high wearing resistivity, and the surface resistivity thereof is not lowered under a high humid condition, consequently the problem of image flowing is not occurred, and to provide an image forming apparatus, an image forming method and a processing cartridge each using the electrophotographic image carrier.

The inventors have found that the deterioration of the resin layer can be effectively inhibited when the resin layer has a charge transportable structure and contains an anti-oxidant, particularly an anti-oxidant having a specific structure.

An electrophotographic image carrier comprising an electric conductive substrate provided thereon, a photoreceptor comprising a photoreceptive layer and a resin layer, in which the resin layer comprises a siloxane resin having a charge transportable structural unit and a cross-linked structure, and the resin layer contains an anti-oxidant.

An electrophotographic photoreceptor comprising a resin layer which comprises a siloxane resin having a cross-linked structure which is formed by reacting an organic silicon compound having a hydroxyl group or a hydrolyzable group with a compound having a charge transportable structural unit, and the resin layer contains an anti-oxidant.

The electrophotographic photoreceptor wherein the resin layer comprises a siloxane resin having a cross-linked structure represented by the following Formula 1.

Formula 1

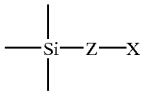

wherein X is a structural unit having charge transportability, and Z is an optional linking group having two or more valences.

The electrophotographic photoreceptor wherein Z in Formula 1 is a substituted or unsubstituted alkylene group or a substituted or unsubstituted arylene group.

The electrophotographic photoreceptor wherein Z in Formula 1 is an atom or a group each having two or more valences when the adjacently bonded atoms (the silicon atom Si and the carbon atom C constituting a part of the charge transportable structural unit) are removed.

The electrophotographic photoreceptor wherein Z in Formula 1 is O, S or NR, and R in Formula 1 is H or a mono-valent organic group.

An electrophotographic photoreceptor comprising a resin layer which comprises a siloxane resin having a cross-linked structure which is formed by reacting an organic silicon compound having a hydroxyl group or a hydrolyzable group with a compound having a charge transportable structural unit which has a hydroxyl group, and the resin layer contains an anti-oxidant.

The electrophotographic photoreceptor, wherein the anti-oxidant is a hindered phenol compound.

The electrophotographic photoreceptor, wherein the anti-oxidant is a hindered amine compound.

The electrophotographic photoreceptor, wherein the anti-oxidant is an organic phosphor anti-oxidation compound.

The electrophotographic photoreceptor wherein the anti-oxidant is an organic sulfur anti-oxidation compound.

The electrophotographic photoreceptor, wherein the resin layer is arranged as the outermost layer.

An image forming method using the electrophotographic image carrier comprising photoreceptor, which comprises the steps of charging, image wise exposing, developing, transferring and cleaning.

An image forming apparatus comprises the electrophotographic image carrier and processes of charging, image wise exposing, developing, transferring and cleaning.

A processing cartridge to be used for image forming through the processes of charging, image wise exposing, developing, transferring and cleaning in which the processing cartridge comprises a combination of the electrophotographic image carrier with at least one of a charging device, an image exposing device, a developing device, a transferring device and a cleaning device.

An electrophotographic image carrier comprising a photoreceptor having a layer containing a siloxane resin having a cross-linked structure.

The electrophotographic image carrier wherein the layer containing the siloxane resin having the cross-linked structure is a resin layer formed by reacting an organic silicon compound having a hydroxyl group or a hydrolyzable group with colloidal silica.

The electrophotographic image carrier, wherein the photoreceptor contains a layer containing a siloxane resin having a charge transportable structural unit and a cross-linked structure.

The electrophotographic image carrier, wherein the photoreceptor contains a layer containing a siloxane resin having a charge transporting ability and a cross-linked structure.

The electrophotographic image carrier, wherein the siloxane resin having a charge transporting ability and a cross-linked structure is a siloxane resin formed by reacting an organic silicon compound having a hydroxyl group of a hydrolyzable group with a compound having a structural unit which has a hydroxyl group and a charge transporting ability.

The electrophotographic image carrier, wherein the layer containing the siloxane resin having the charge transporting ability and the cross-linked structure contains an antioxidant.

The electrophotographic image carrier, wherein the layer containing the siloxane resin having the charge transporting ability and the cross-linked structure contains a hindered phenol compound or a hindered amine compound as an antioxidant.

The electrophotographic image carrier, wherein the layer containing the siloxane resin having the cross-linked structure is a surface protective layer.

The electrophotographic image carrier wherein the image formation is carried out while heating the photoreceptor by a heating device from the interior of the photoreceptor.

An image forming method wherein the electrophotographic image carrier is used and the method comprises the step of heating the electro-photographic image carrier.

The image forming method wherein the step of heating the electrophotographic image carrier is carried out from the interior of the photoreceptor thereof.

An image forming apparatus wherein the electrophotographic image carrier is used and an image is formed through the processes of charging, imagewise exposing, developing, transferring, separating and cleaning.

A processing cartridge to be used for forming an image using the electrophotographic image carrier and through processes of charging, imagewise exposing, developing, transferring, separating and cleaning, wherein the processing cartridge comprises a combination of the electrophotographic image carrier and at least one of a charging device, an image exposing device, a developing device, a transferring or separating device and a cleaning device.

DETAILED DESCRIPTION OF THE INVENTION

In the invention, the photorecseptor indicates, differently a little from usual meaning, layers mainly constituting the electrophotographic photoreceptor including a light-sensitive layer, a surface protective layer for protecting or aiding the light-sensitive layer and an interlayer for preventing the bad influence of the electric conductive layer to the light-sensitive layer.

The image carrier in the invention indicates an image carrier in usual meaning which further includes the electric conductive layer and the substrate. Besides, one including the electric conductive layer and the substrate is usually called as the photoreceptor. However, in the invention, the "photoreceptor" is clearly distinguished from the "image carrier".

Figure 1:
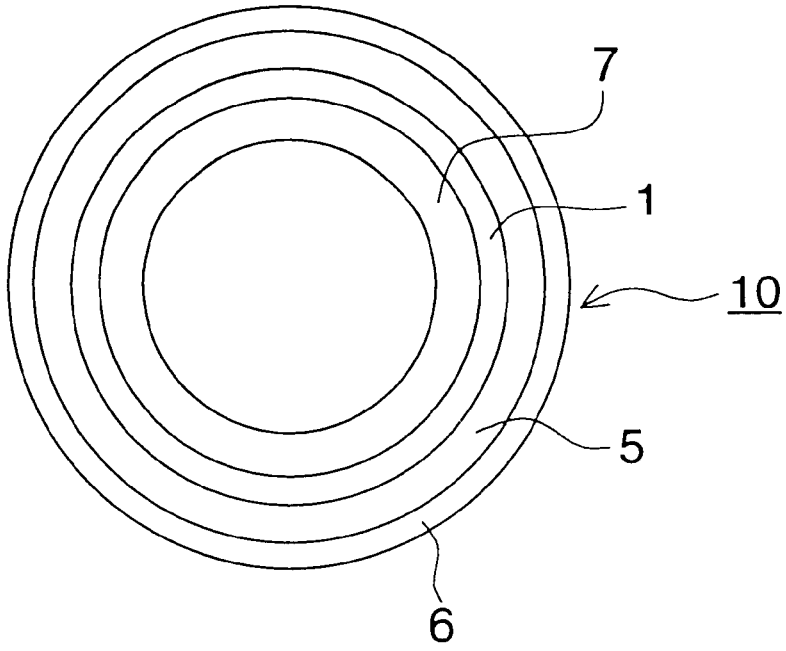
FIG. 1 shows the cross section of a electrophotographic image carrier according to the invention.

For example, an embodiment shown in FIG. 1, one of the embodiment of the invention, in which a plane heater is built-in, is called as the image carrier.

FIG. 1 shows a cross section of an image carrier according to the invention. In the figure, the photoreceptor drum 10 is constituted as follows: a photoreceptive layer 5 composed of an interlayer, a charge generating layer and a charge transporting layer is provided on a aluminum substrate 1, and a surface protective layer 6 provided on the light-sensitive layer 5, furthermore a heating device 7, on which a plane heater is rounded coilwise, is installed inside of the substrate.

As the method for heating relating to the invention, a method may be applied by which hot air is forcibly blown to the surface of photoreceptor or into the interior of photoreceptor drum, but it is further preferable to directly heat from the interior of the photoreceptor drum from the heater built-in the drum, by such the method the drum can be uniformly heated even when any portion of the drum is stopped just under the charging electrode. The relative humidity of the image carrier (photoreceptor drum) can be lowered by heating according to such the heating method, and a good image can be obtained on the whole area of the image under a high humid condition. Consequently, the direct heating by the heater built in the image carrier itself is most effective. Moreover, the effect can be further enhanced by the use of an external heater in combination.

There is no limitation on the heating device, for example, a plane heater composed of a heat generator such as Nichrome wire sandwiched by a resin support such as polyethylene terephthalate or a ceramics heater may be used.

The temperature of the photoreceptor is preferably within the range of from 30° C. to 65° C. under a condition of relative humidity of not less than 50%, and within the range of from 40° C. to 50° C. under a condition of relative humidity of not less than 70%.

It is advantageous for preventing the image flowing that the photoreceptor drum is rotated while holding the temperature within the above-mentioned range in the period from the switch on of the power source to the image formation. The image flowing can be inhibited at a lower temperature by such the operation.

In the invention, the layer containing the siloxane resin having the cross-linked structure is preferably a surface protective layer, more preferably a layer containing the siloxane resin which has a structural unit having a charge transporting ability and the cross-linked structure.

The photoreceptor which has the resin layer comprising the siloxane resin having a cross-linked structure and the charge transportable structural unit is considerably improved in the mechanical strength of the layer which is a drawback of the organic photoreceptor and in the electric properties thereof which is a problem of layer of the siloxane resin having the cross-linked structure.

It has been also found as a result of studying to improve such the problem that the anti-oxidant can be effectively contained in the layer of the siloxane resin having the charge transportable structure since the siloxane resin having the charge transportable structure has a higher miscibility with the anti-oxidant compared to the usual siloxane resin which causes the problem of miscibility with the anti-oxidant. Accordingly, the deterioration caused by oxidant gas such as ozone or $NO_x$ can be considerably inhibited during a prolonged period of time.

The siloxane resin having a cross-linked structure is a resin prepared by newly forming a chemical bond between molecular of monomer, oligomer or polymer, each of which previously has a siloxane bond in the structural unit thereof, by aid of a catalyst or a cross-linking agent to form a three dimensional network structure, or by forming a three dimensional network structure of moleculars of monomer, oligomer or polymer through a siloxane bond. The structural unit usable is usually one capable of forming the three dimensional network structure by a condensation reaction of alkoxysilane or that of silanol. A particle such as colloidal silica may be contained into the tree dimensional network structure.

In the invention, the hydrolyzable group of the organic silicon compound having a hydroxyl group or a hydrolyzable group is, for example, a methoxy group, an ethoxy group, a methylethylketoxim group, a diethylamino group, an acetoxy group, a propenoxy group, a propenoxy group, a butoxy group or an methoxyethoxy group. Among them, a hydrolyzable group represented by —OR is preferred, in which R is a group of atoms necessary to form an alkoxy group and the number of carbon atom is preferably from 1 to 6. Examples of R include a methyl group, an ethyl group, a propyl group, a butyl group, a pentyl group, a hexyl group and a methoxethyl group.

Generally, the reaction of the organic silicon compound for making a high molecular weight is inhibited when the number n of the hydrolyzable group is one. When n is 2, 3 or 4, the high molecular weight making reaction is easily progressed, and when n 3 or 4, the crosslinking re action can be strongly progressed. Accordingly, the storage ability of the coating liquid of the layer and the hardness of the coated layer can be controlled by controlling such the factors.

Besides, it has been known that the charge transporting substance in the properties of the photoreceptive layer is deteriorated by an oxidant gas such as ozone or $NO_x$ formed by an electrode for charging, transferring or separating. The oxidation of the photoreceptor causes lowering in the charging property and the light sensitivity, as a result a fault in the image such as fogging or lowering in the image density is occurred. However, the deterioration is apparently inhibited in an usual photoreceptor since the photoreceptive layer is suitably worn and the extreme surface, which is mostly deteriorated, is suitably worn and the deteriorated substance and the contamination substance on the surface is removed.

In contrast, in the photoreceptor having the resin layer containing the siloxane resin having the charge transportable structural unit, the mechanical strength and the electrophotographic property of the photoreceptor can be raised by the strength of the siloxane resin and the presence of the charge transportable unit, and an advantage can be obtained that the wearing amount of the photoreceptor is extremely reduced. However, the reduced wearing amount of the photoreceptor makes difficult to remove the effect of the contamination substance formed by the effect of the oxidant gas such as ozone or $NO_x$. Accordingly, it is strongly required to inhibit the deterioration of the photoreceptor under the condition in which the wearing is difficult to occur.

A technology of addition of various kinds of anti-deterioration agent has been developed for protecting the photoreceptor from the oxidant gas. However, a usual siloxane resin has a problem that it is difficult to form a uniform layer since the siloxane resin is inferior to an ordinary organic high molecular material in the miscibility with the anti-deterioration agent. It is widely known as to the resin having a cross-linked structure such as the siloxane resin that the miscibility with the additive is considerably varied depending on the structure or density of the cross-linking. In the case of a low miscibility, the additive or the not reacted charge transportable substance is educed, and the layer is roughed by bleeding out of such the substance when the separation is occurred at the interface of the layers or the surface of the layer. The roughed layer causes a deterioration of the layer strength and the image quality. Moreover, when the layer is the outermost layer, an adhesion of foreign matter on the photoreceptor surface is accelerated and a filming of toner or paper powder is easily occurred.

As a result of studying for improving the above-mentioned problems of the resin layer comprising the siloxane resin, it is found that the siloxane resin having the charge transportable structure and the cross-linked structure can be effectively contained in the layer without any deformation of the layer and the deterioration caused by the oxidant gas such as ozone and $NO_x$ can be considerably inhibited in the course of prolonged period of using time since the resin has a suitable miscibility with an anti-oxidant having a relative high molecular weight which is hardly mixed with an usual siloxane resin. It is further found that the miscibility is particularly excellent when the layer comprises a cross-linked siloxane resin having formed by reacting an organic silicon compound having a hydroxyl group or a hydrolyzable group with a compound having a charge transportable structural unit. The resin layer according to the invention has a low wearing property, and a good image quality can be maintained for a prolonged period of using time without the filming problem.

The resin layer according to the invention is preferably arranged at the outermost surface of the photoreceptor for attaining the object of the invention. However, an over coating layer may be provided on the resin layer from the viewpoint of another property of the photoreceptor. Moreover, one of the layers constituting the photoreceptive layer may be the resin layer according to the invention. Accordingly, when the photoreceptive layer has a single layer type structure in which the photoreceptive layer is not separated to a charge transportation layer and a charge generation layer, the cross-linked siloxane resin having the charge transportable structural unit and the anti-oxidant may be contained in such the layer.

It is necessary that the resin layer according to the invention contains the siloxane resin in an amount necessary to attain the object of the invention, and another substance for giving another function may be added with together.

The electrophotographic photoreceptor to be used in the invention is described in detail below.

In the invention, the cross-linked siloxane resin having the charge transportable structural unit can be prepared by a known method using an organic silicon compound having hydroxyl group or a hydrolyzable group. Such the organic silicon compound is represented by the following Formula A, B, C or D.

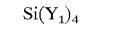

Formula A

Formula B

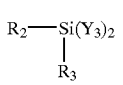

Formula C

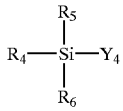

Formula D

In the formulas, $R_1$ through $R_6$ are each an organic group in which a carbon atom thereof is directly boned with the silicon atom in the formula, $Y_1$ through $Y_4$ are each a hydroxyl group or a hyrolyzable group.

When $Y_1$ to $Y_4$ in the above formulas is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by $R_1$ through $R_6$ in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β-(3,4-epoxycyclohexyl) ethyl group, an (metha)acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mnercapto-containing group such as a γ-mercaptopropyl group, an amino-containing group such as a γ-aminopropyl group and an N-β-(aminoethyl)-γaminopropyl group, a halogen-containing group such as a γ-chloropropyl group, an 1,1,1-trifluoropropyl group, a nonafluorohexyl group and perfluorooctylethyl group, and an alkyl group substituted by a nitro group or a cyano group. The organic groups represented by $R_1$ through $R_6$ may be the same as or different from each other.

Generally, the reaction of the organic silicon compound for making a high molecular weight is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling such the factors can control the storage ability of the coating liquid of the layer and the hardness of the coated layer.

The siloxane resin of the invention is a resin which is formed and hardened by a reaction (including a hydrolyzing, and a reaction in the presence of a catalyst or a cross-linking agent) of a monomer, an oligomer or a polymer having a siloxane bond in the chemical structural thereof unit to form a three-dimensional network structure.

In another words, the siloxane resin of the invention means a cross-linked siloxane resin formed as a result of the formation of three-dimensional network structure by acceleration of siloxane bonding formation of the organic compound having a siloxane bond by a hydrolyzing reaction and a dehydrating reaction.

Moreover, the siloxane resin may be a resin containing a silica particle as a part of the cross-l inked structure by adding a colloidal silica particle having a hydroxyl group or a hydrolyzable group.

In the invention the cross-linked siloxane resin having a charge transportable structural unit is a siloxane resin in which a chemical structure showing a drift mobility of electron or a hole (=the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

The charge transportable structural unit is a chemical structural unit or a residue of charge transportable compound showing an electron or hole mobility. In other definition, the charge transportable structural unit is a chemical structural unit or a residue of charge transportable compound by which an electric current caused by charge transportation can be detected by a known method for detecting the charge transportation ability such as Time-Of-Flight method.

The charge transportable compound capable of forming the structural unit having the charge transporting ability in the siloxane resin by reacting with the organic silicon compound is described below.

Examples of hole transporting type CTM which each are contained in the siloxane resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM which each are contained in the siloxane resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloroanthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalononitrile, polynitro-9-fluorenylidenedicyanomethylenemalonodinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and meritic acid.

In the invention, preferable charge transportable structural units are residues of usually used charge transporting compounds such as mentioned above. The residue is bonded with the bonding atom or group represented by Z through the carbon atom or the silicon atom constituting the charge transporting compound so as to be contained in the siloxane resin.

Formula 1

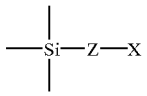

In the formula, X is a structural unit having a charge transporting ability, and Z is a bonding group having two or more valences. It is preferable that Z in the above Formula 1 is an atom or a group having two or more valences when the adjacently bonded atoms (the silicon atom Si and the carbon atom C constituting a part of the charge transportable unit) are removed.

When Z is three or more valent atom, the bonding hand other than those each bonding with Si and C is bonded with any atom constituting the hardened resin, or another atom or molecular group.

In the above-mentioned formula, the atom represented by Z is preferably an oxygen atom O, a sulfur atom S or nitrogen atom N.

When Z is a nitrogen atom N, the above-mentioned bonding group is represented by —NR—, in which R is a hydrogen atom or a mono-valent organic group.

Although the charge transportable structural unit X is shown as a mono-valent group in the formula, the structural unit may be bonded as a two or more valences cross-linking group in the hardened resin or as a simple pendant group when the charge transporting compounds to be reacted with the siloxane resin has two or more functional groups.

The O, S or N atoms is a bonding atom or group for taking the charge transportable structural unit into the siloxane resin, which is formed by reaction of a hydroxyl group, mercapto group or amine introduced into the charge transportable compound with the organic silicon compound having a hydroxyl group or a hydrolyzable group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also compounds having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$$X—(R_7—OH)_m \quad m \geqq 1$$

wherein

X: structural unit providing charge transportability $R_7$: single bonding group, each of a substituted or an unsubstituted alkylene or arylene group m: preferably 1 to 5

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds
T-1
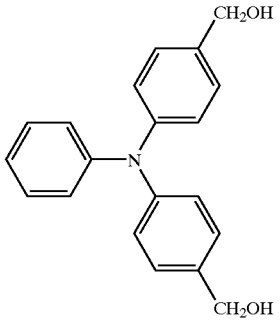
T-2
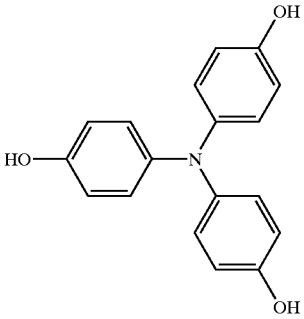
T-3
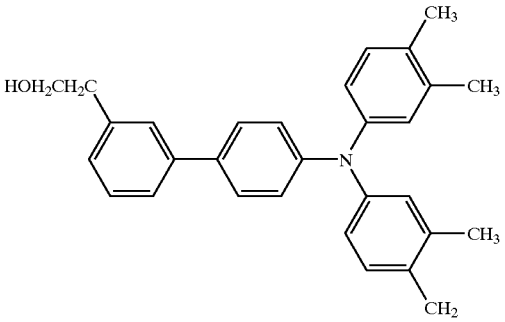
T-4
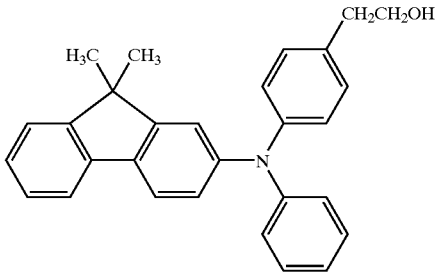
T-5
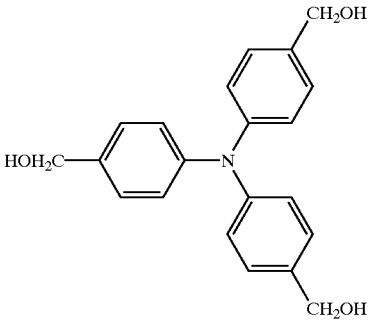
-continued
T-6
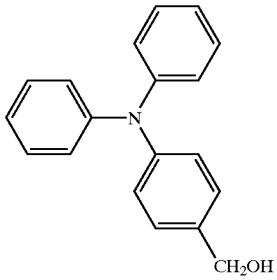
T-7
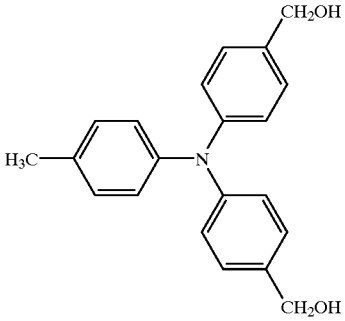
T-8
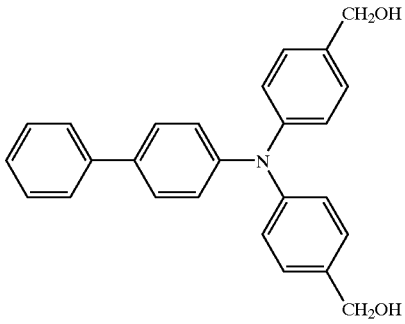
T-9
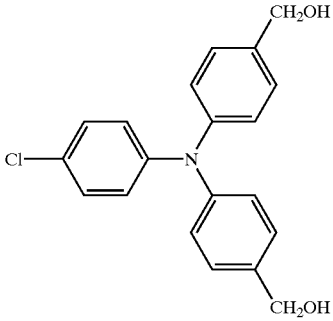
T-10
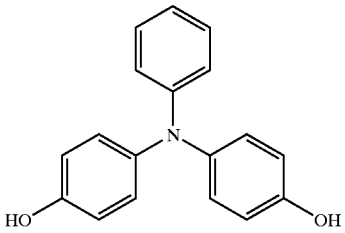

-continued
T-11
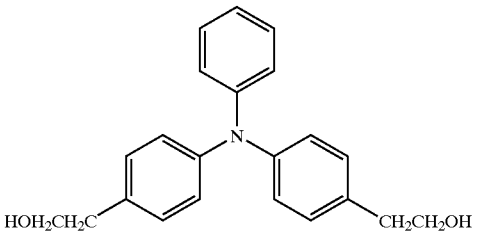
T-12
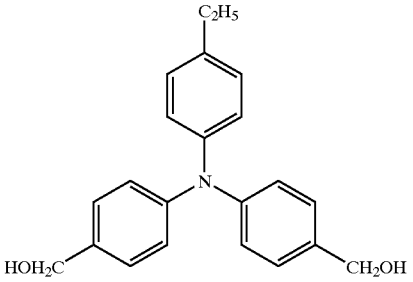
T-13
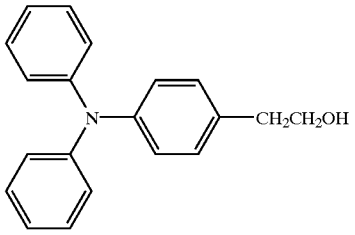
T-14
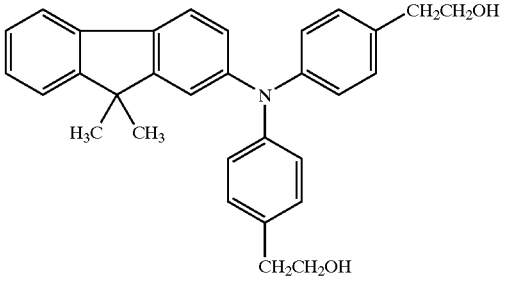
T-15
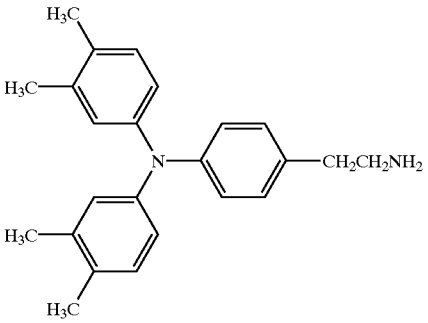
-continued
T-16
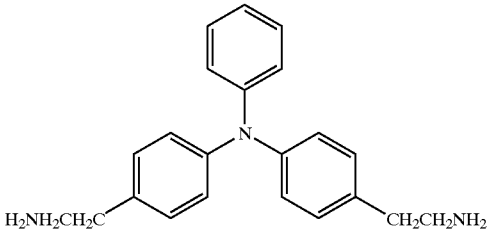
T-17
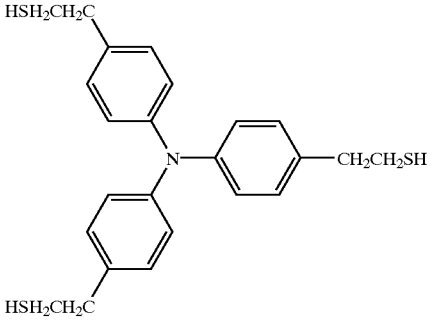
2. Hydrazine Based Compounds
H-1
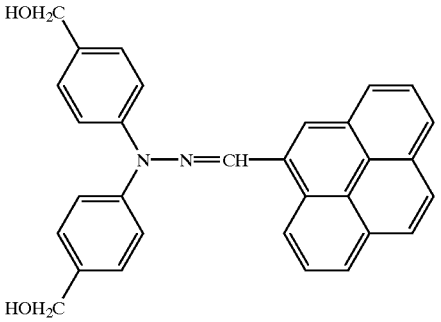
H-2
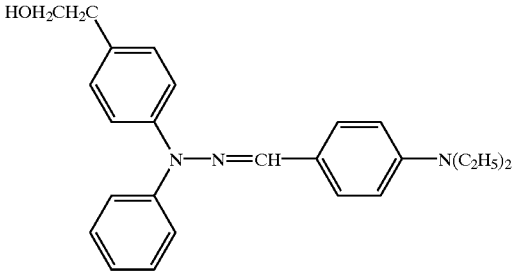
H-3
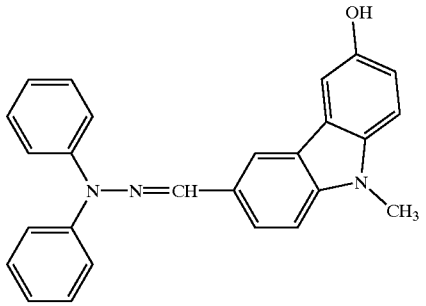

-continued
H-4
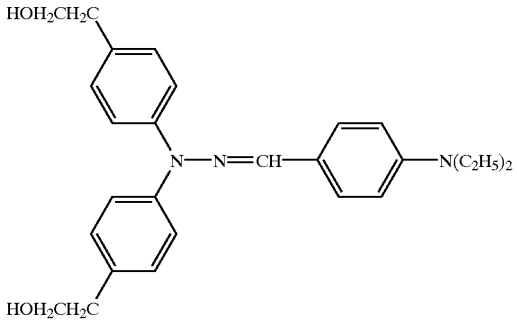
H-5
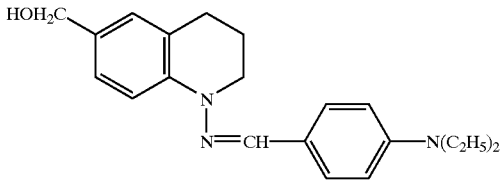
H-6
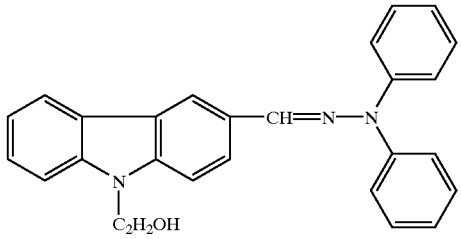
H-7
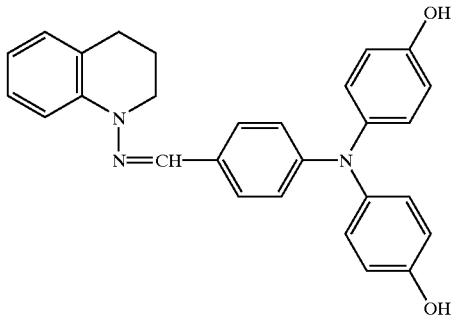
H-8
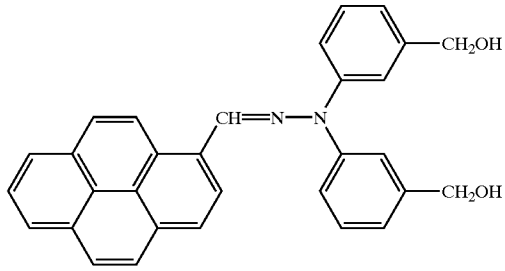
3. Stilbene Based Compounds
S-1
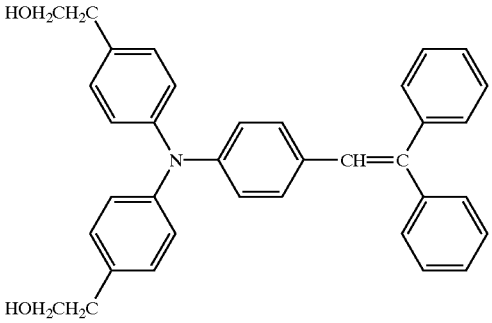
S-2
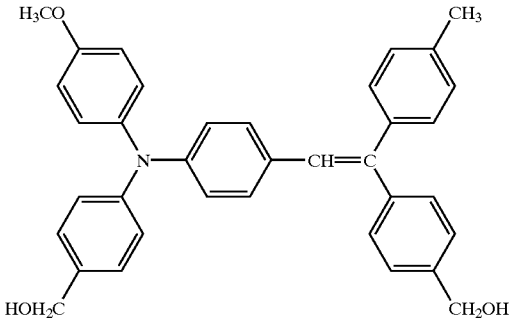
S-3
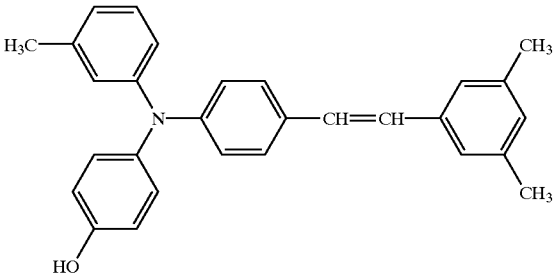
S-4
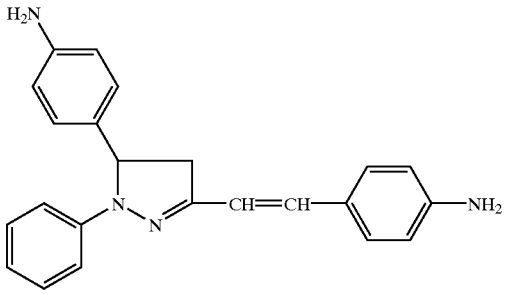

-continued
S-5
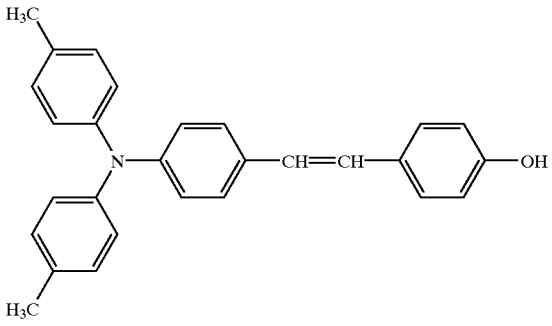
S-6
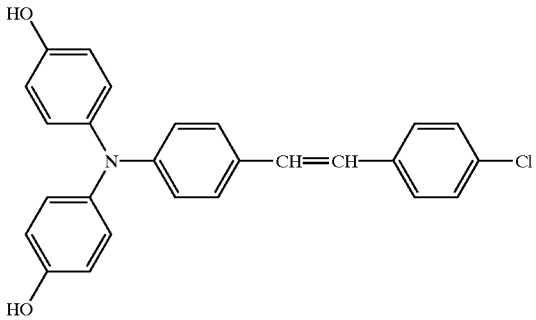
S-7
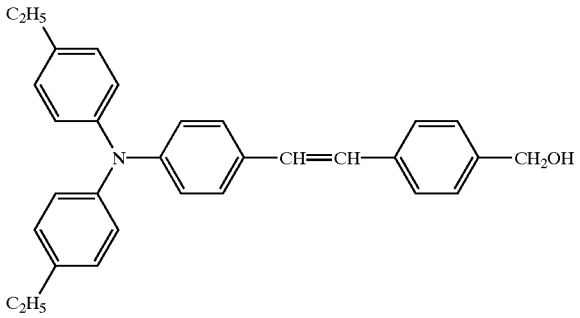
S-8
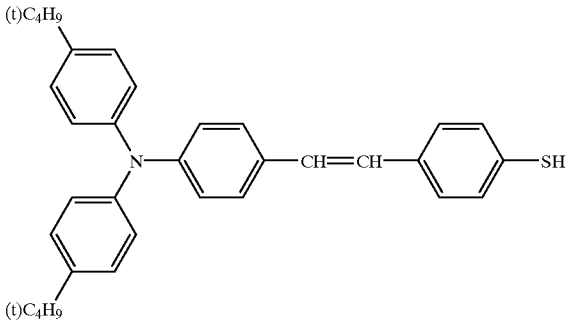
-continued
S-9
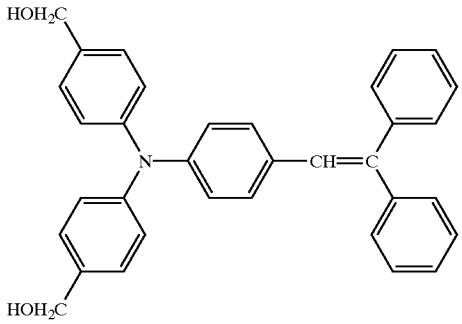
S-10
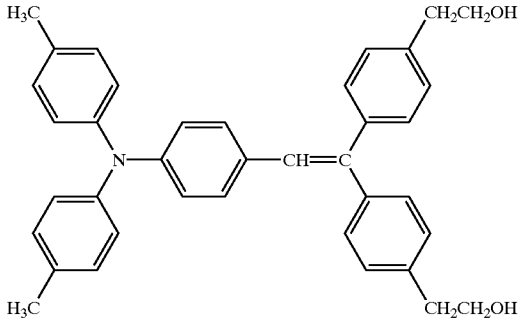
S-11
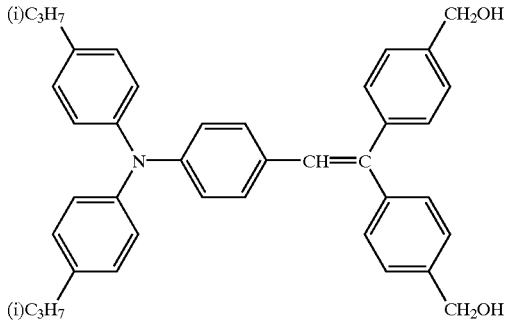
S-12
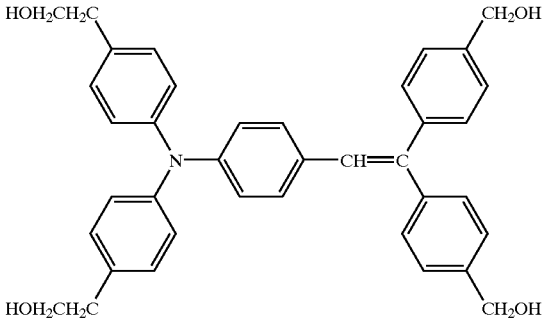

4. Benzidine Based Compounds
Be-1
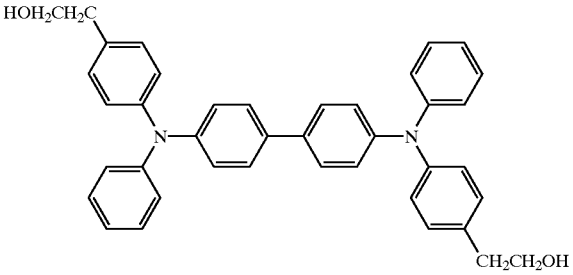
Be-2
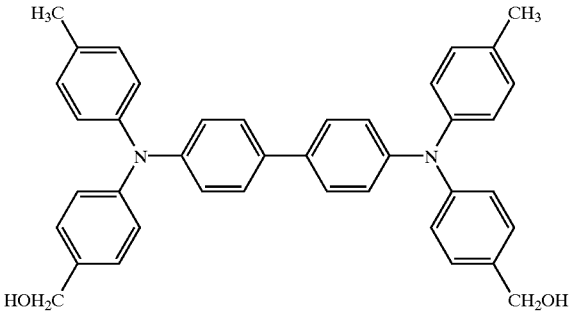
Be-3
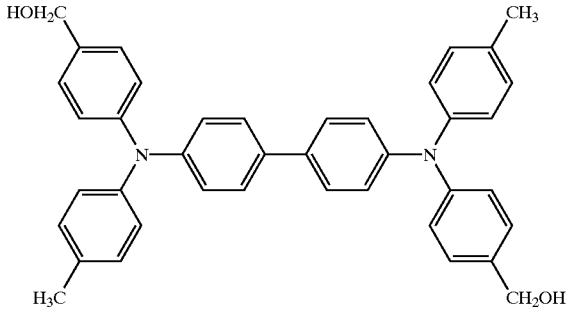
Be-4
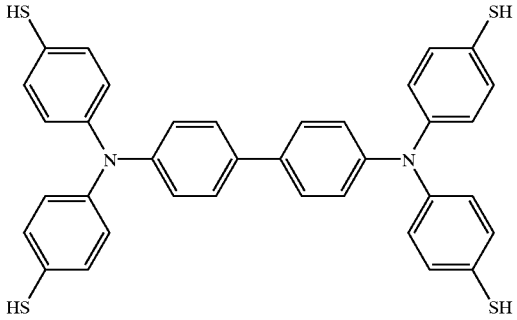
Be-5
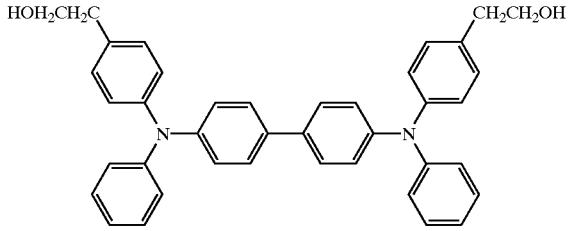
-continued
Be-6
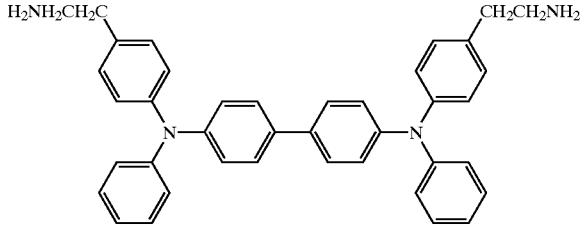
Be-7
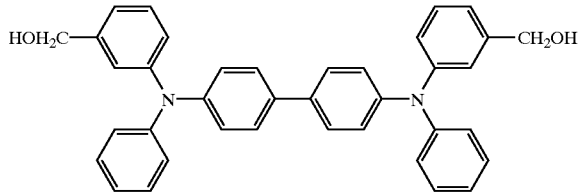
5. Butadiene Based Compounds
Bu-1
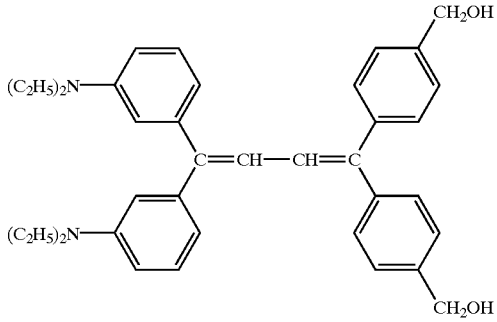
6. Other Compounds
So-1
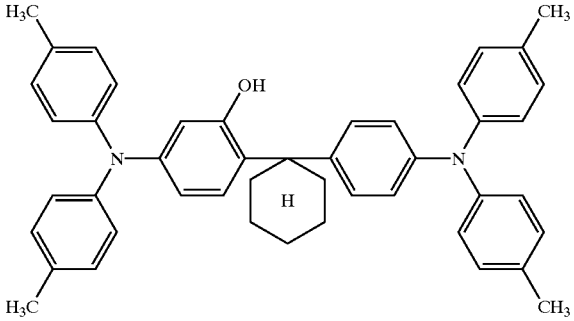
So-2
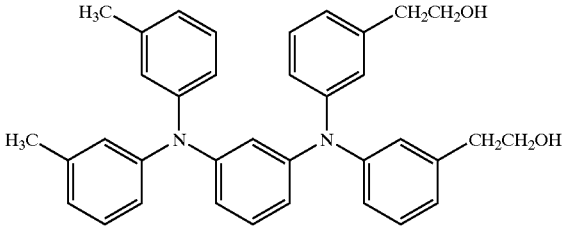

-continued

So-3

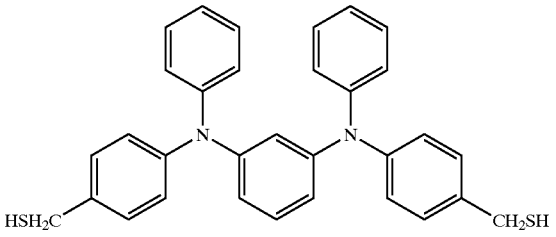

Next, a synthesis example of the charge transportable compound will be described.

Synthesis of Exemplified Compound T-1

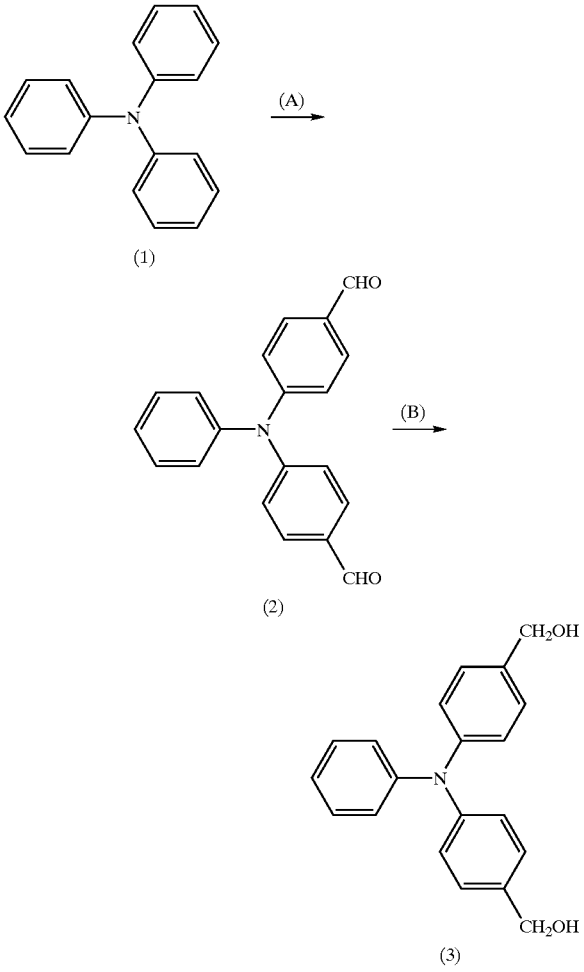

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the same, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

Synthesis of Exemplified Compound S-1

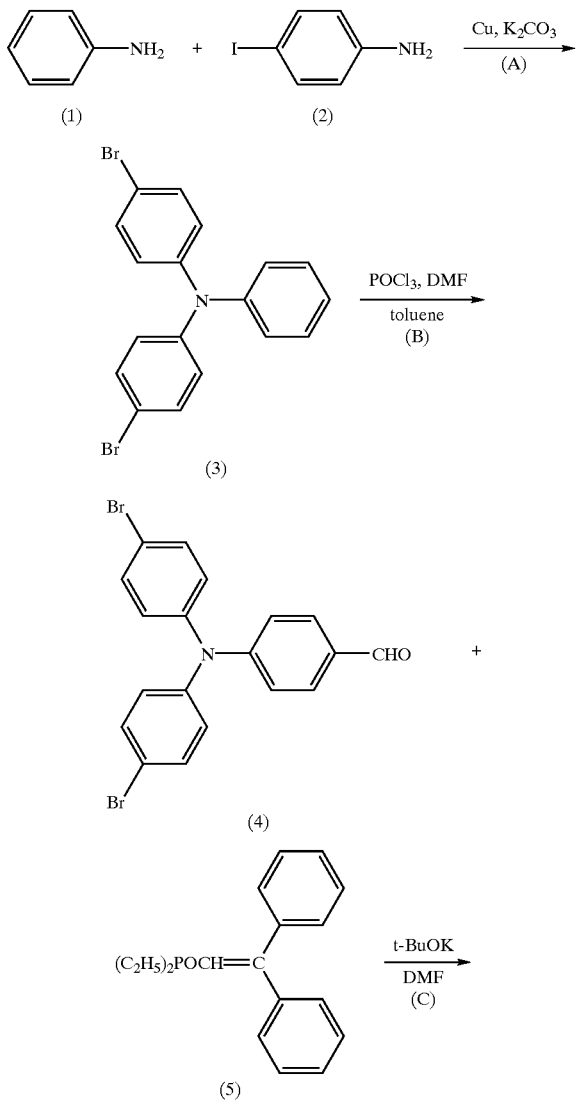

-continued

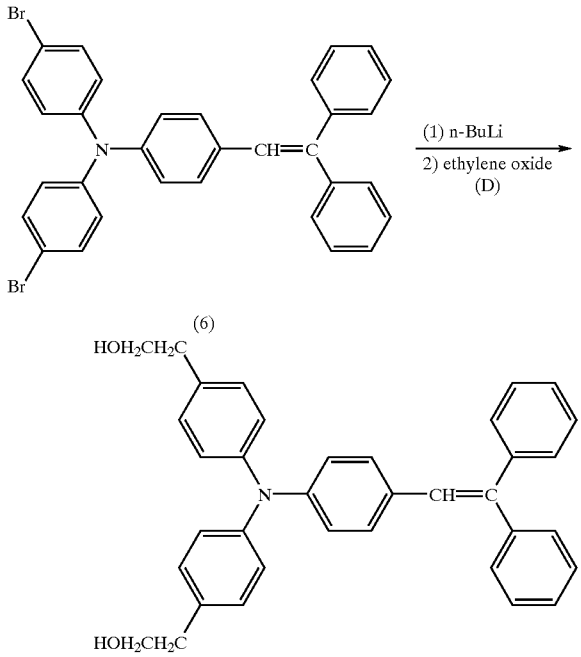

Step A

Placed in a 300 ml flask equipped with a thermometer and a stirrer were 30 g of Cu, 60 g of $K_2CO_3$, 8 g of Compound (1), and 100 g of Compound (2) and the resulting mixture was heated to about 180° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R_8—SH)_m \quad m \geqq 1$$

wherein

X: charge transportability providing group $R_8$: single bonding group, each of a substituted or an unsubstituted alkylene group or an arylene group m: preferably 1 to 5

Of these, listed as representative compounds are such as those described below.

V-1

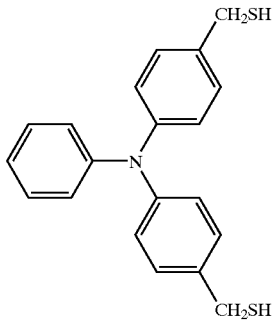

V-2

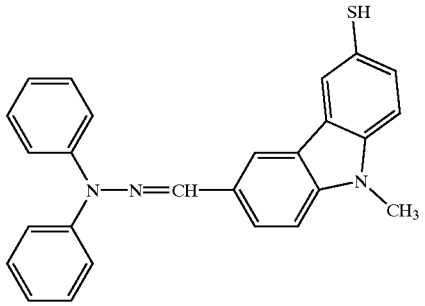

-continued

V-3

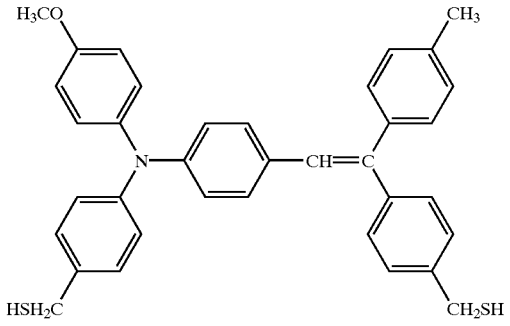

V-4

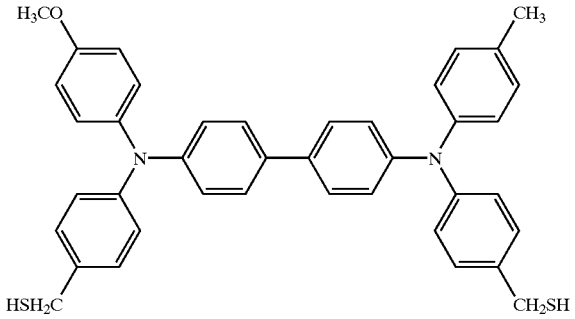

V-5

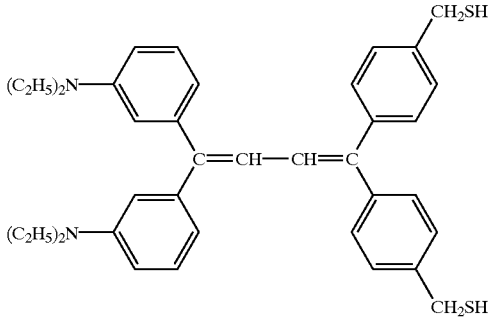

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_9—NR_{10}H)_m m \geq 1$$

wherein

X: charge transportability providing group $R_9$: single bonding group, each of a substituted or an unsubstituted alkylene group or an arylene group $R_{10}$: H, a substituted or unsubstituted alkyl group, a substituted or an unsubstituted aryl group m: preferably 1 to 5

Of these, listed as representative compounds are such as those described below.

W-1

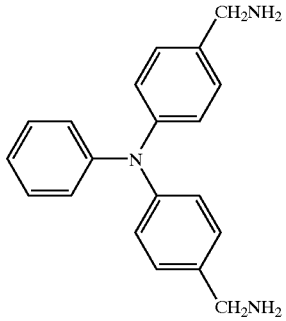

W-2

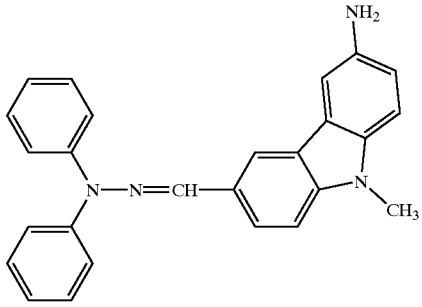

W-3

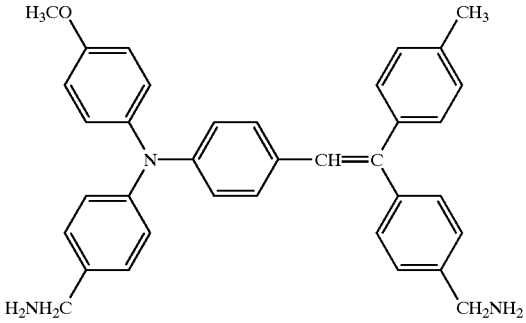

W-4

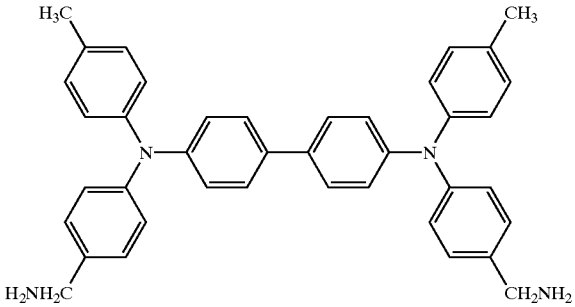

-continued

W-5

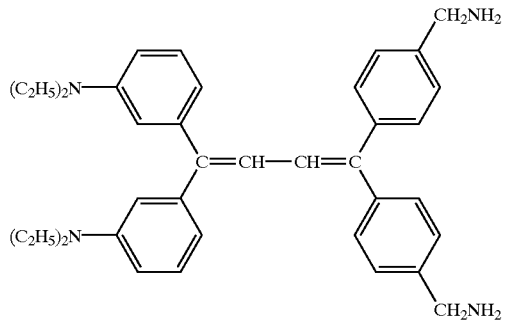

W-6

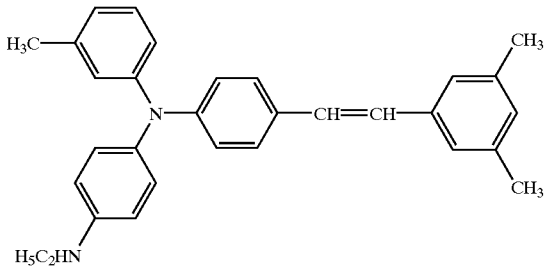

Of charge transportable compounds having an amino group, in the case of primary amine compounds (—$NH_2$), two hydrogen atoms may react with the organic silicone compound, and bonding to the siloxane structure may take place. In the case of secondary amine compounds (—$NHR_{10}$), one hydrogen atom may react with the organic silicone compound, and the remaining $R_{10}$ may be any of a remaining group as a branch, a group resulting in a crosslinking reaction, or a compound group having charge transportability.

The charge transportable compound having a silicon-containing group is described below.

The charge transportable compound having a silicon-containing group is a charge transportable substance having the following structure. This compound can form a layer by bonding with the hardened organic silicon compound.

$$X—(—Z—Si—(R_{11})_{3-a}(R_{12})_a)_n$$

In the formula, X is a group including the charge transportable structural unit, $R_{11}$ is a hydrogen atom, a substituted or unsubstituted alkyl group or a substituted or unsubstituted aryl group, $R_{12}$ is a hydrolyzable group or a hydroxyl group, Z is a substituted or unsubstituted alkylene group or a substituted or unsubstituted arylene group, a is an integer of from 1 to 3, and n is an integer.

Raw materials of the siloxane resin: The compounds represented Formula A through D (hereinafter referred to A through D) respectively. The ratio of those is preferably to use organic silicon compound: from 0.05 to 1 moles of C+D component per 1 mole of A+B component.

When colloidal silica E is added, it is preferable to use from 1 to 30 parts by weight of E per 100 parts by weight of total amount of A+B+C+D component.

The adding amount of the reactive charge transportable compound F capable of forming the resin layer by reacting with the organic silicon compound and the colloidal silica is preferably from 1 to 500 parts by weight per 100 parts by weight of the total amount of the component of A+B+C+D. When the amount of A+B component is smaller than the above-mentioned range, the hardness of the siloxane resin layer is shortened since the cross-linking density is too low. When the amount of A+B component is too large, the hardness of the layer is sufficient but the layer is become fragile. A shortage and an excess of the colloidal silica component E show similar effects to those of the component A+B, respectively. A too small amount of component F causes lowering in the sensitivity and raising in the remained potential since the charge transporting ability of the siloxane resin layer is become too low. When the amount of component F is excessive, the strength of the resin layer tends to be lowered.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Usually, the three-dimensional network structure can be formed by a condensation reaction of a composition containing alkoxysilane or alkoxysilane and colloidal silica.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octate, dibutyl tin dictate, dibutyl tin dilaurate, dibutyl tin mercaptide, dibutyl tin thiocarboxylate and dibutyl tin maleate, an aluminum or zinc salt of octenic acid or naphthenic acid and an acetylacetone complex.

The anti-oxidant of the invention is typically one capable of preventing or inhibiting effects of oxygen on an automatically oxidizable substance existing in the interior or on the surface of photoreceptor, under a condition with lighting, heating or discharging. Examples of such the substance include the followings.

(1) Radical chain preventing agent
  Phenol type ant-oxidant
  Hindered phenol type compounds
  Amine type antioxidant
  Hindered amine type compounds
  Diallyldiamine type compounds
  Diallylamine type compounds
(2) Peroxide compound decomposing agent
  Sulfur type anti-oxidant
Thioether compounds
  Phosphorous antioxidant
  Phosphorous ester type compounds The hindered phenol type compound is a compound having a high volume organic group at the ortho-position regarding the phenolic OH group or an alkoxide phenolic OH group, and the hindered amine compound is a compound having a high volume group near the N atom. Examples of the high volume organic group include a branched-chain alkyl group, and t-butyl group is preferable.

Among the antioxidants, the radical chain preventing agent (1) is preferable and the hindered phenol compounds and the hindered amine compounds are particularly preferred.

Two or more kinds of the antioxidants may be used in combination, for example, a combination of the hindered phenol type compound (1) and the thioether type antioxidant (2) is preferable.

In the invention, the compound having the hindered amine structure is further preferred since such the compound is effective to prevent blurring of image and the forming of black spot. In another embodiment, a compound having both a hindered phenol structural unit and a hindered amine structural unit in the molecular thereof is also preferred.

The hindered phenol type and the hindered amine type antioxidants preferably usable in the invention include a compound having the structural unit represented by Formula A and that represented by Formula B.

Formula A

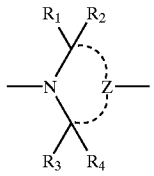

Formula B

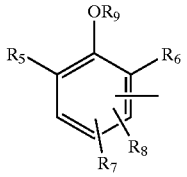

In the formula, $R_1$, $R_2$, $R_3$ and $R_4$ are each a hydrogen atom, an alkyl group or an aryl group, Z is a group of atoms necessary to form a nitrogen-containing heterocyclic ring. One of $R_1$ and $R_2$, and one of $R_3$ and $R_4$ each may be included in Z and form a double bond.

$R_5$ is a branched-chain alkyl group, $R_6$, $R_7$ and $R_8$ are each a hydrogen atom, a hydroxyl group, an alkyl group or an aryl group, and $R_6$, $R_7$ and $R_8$ may be bonded with together to form a ring.

$R_9$ is a hydrogen atom, an alkyl group or an alkylidene group.

$R_1$, $R_2$, $R_3$ and $R_4$ are each preferably an alkyl group having from 1 to 40 carbon atoms, and the alkyl group may have an optional substituent such as an aryl group, an alkoxyl group, a carboxyl group, an amide group and a halogen atom.

Z is a group of atoms necessary to form a nitrogen-containing heterocyclic ring, preferably 5- or 6-member ring. Preferable structures of the rings include a ring of piperidine, piperazine, morpholine, pyrrolidine, imidazolidine, oxazolidine, thiazolidine, selenazolidine, pyrroline, imidazoline, isoindoline, tetrahydroisoquinoline, tetrahydropyridine, dihydropyridine, dihydroisoquinoline, oxazoline, thiazoline, selenazoline and pyrrole. A piperidine ring, a piperazine ring, a morpholine ring and a pyrrolidine ring are particularly preferred.

$R_5$ and $R_6$ are each preferably a ter- or sec-alkyl group having from 3 to 40 carbon atoms.

The alkyl group represented by $R_7$ and $R_8$ is preferably one having from 1 to 40 carbon atoms, and the aryl group represented by $R_7$ and $R_8$ is preferably a phenyl group, a naphthyl group and pyridyl group. A chroman ring is preferably when $R_6$ and $R_7$ form a ring.

The alkyl group and alkylidene group represented by $R_9$ is preferably one having from 1 to 40, more preferably from 1 to 18, carbon atoms.

The content of the hindered phenol type or the hindered amine type antioxidant in the resin is preferably from 0.01 to 25% by weight. When the content is larger than 25% by weight, the charge transporting ability in the resin layer is lowered and the remaining potential tends to be raised. Moreover, the strength of the layer tends to be lowered. An amount from 0.1 to 10% by weight is more preferable.

The antioxidant may be added into a charge generation layer, a charge transportation layer and an interlayer provided under the resin layer. The adding amount of the antioxidant into each of such the layers is preferably from 0.01 to 25% by weight.

Any antioxidant may be usable in the invention without any limitation as long as the above-mentioned conditions are satisfied. Concrete examples of them are shown below.

(1) Examples of compound having a hindered phenol structure 1-1

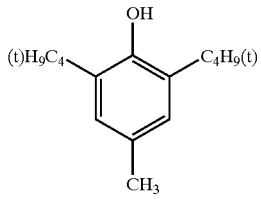

1-2

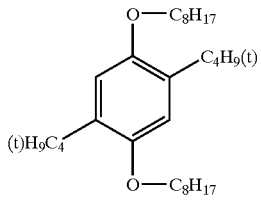

-continued
1-3
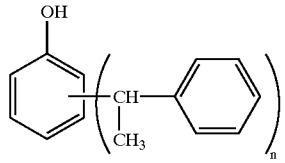
n: 2 or 3
1-4
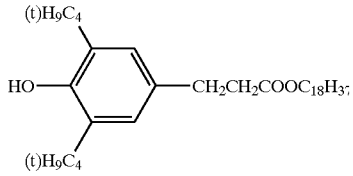
1-5
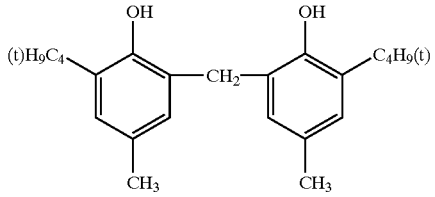
1-6
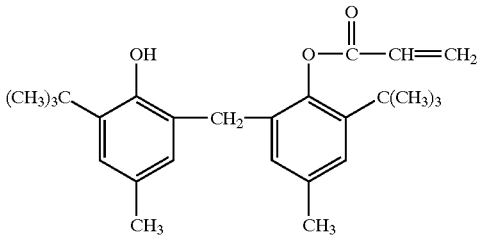
1-7
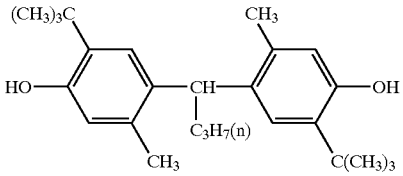
1-8
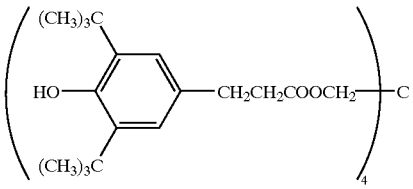
1-9
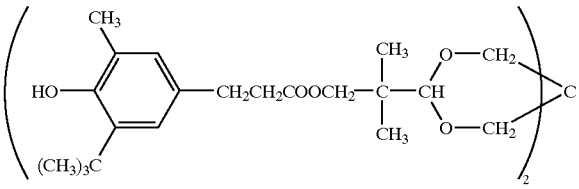

-continued
1-10
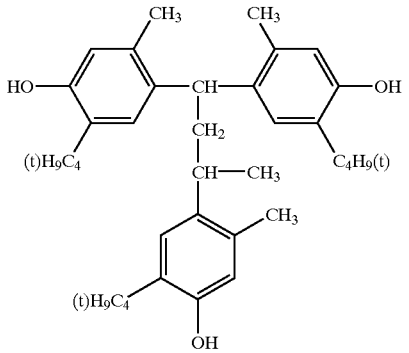
1-11
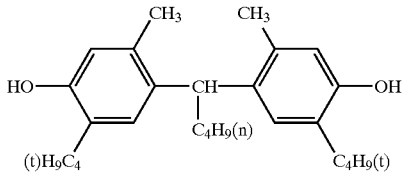
1-12
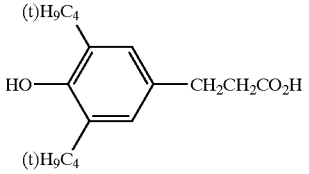
1-13
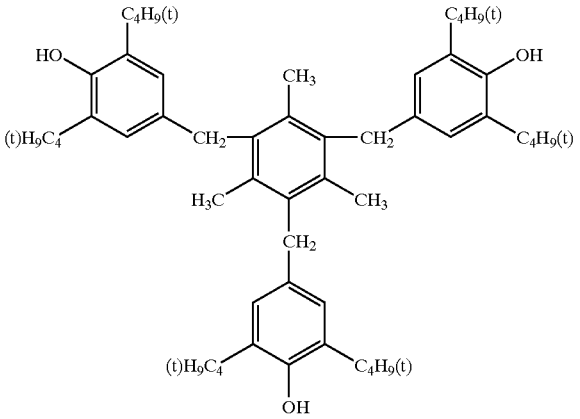
1-14
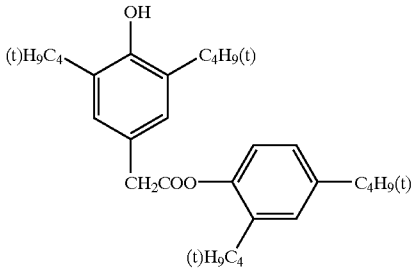
1-15
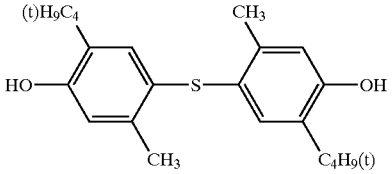

-continued
1-16
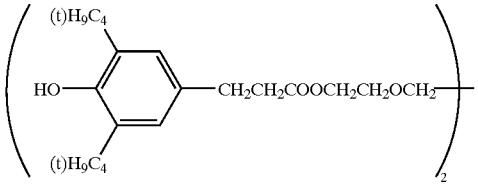
1-17
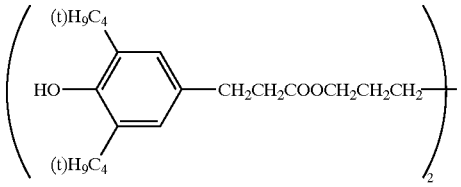
1-18
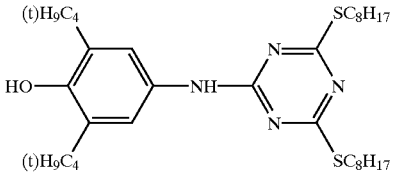
1-19
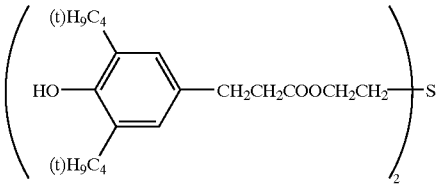
1-20
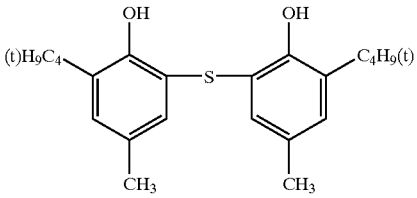
1-21
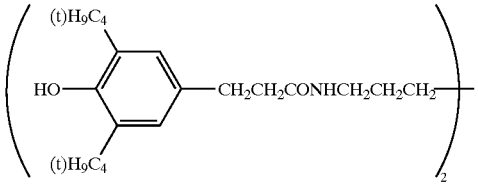
1-22
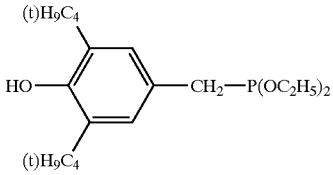
1-23
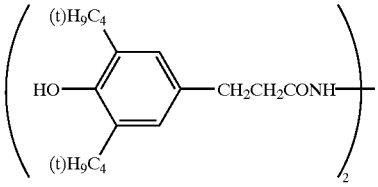

-continued
1-24
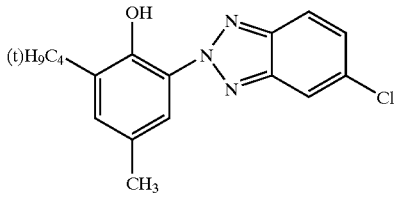
1-25
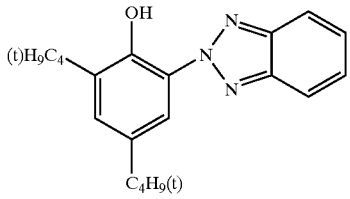
1-26
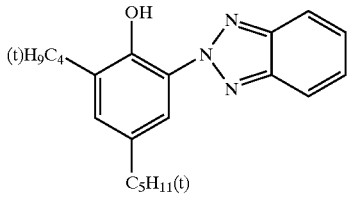
1-27
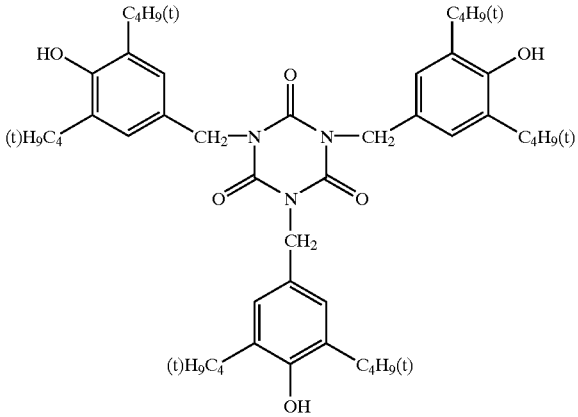
1-28
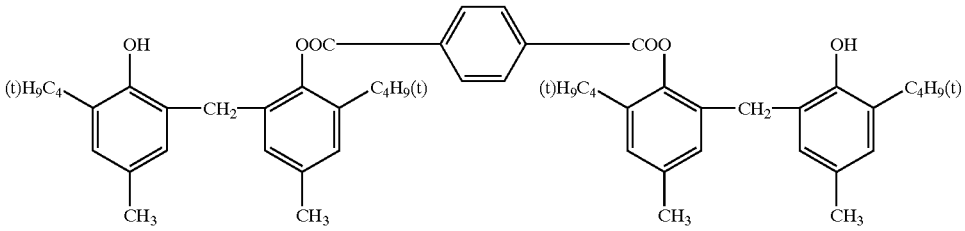
1-29
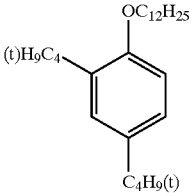

-continued
1-30
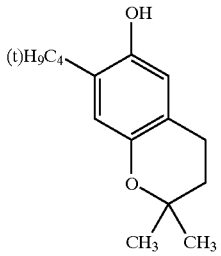
1-31
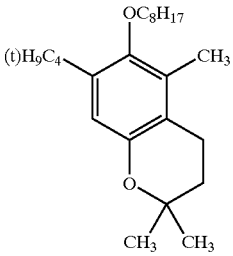
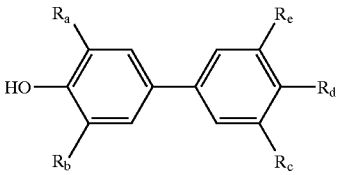
| | $R_a$ | $R_b$ | $R_c$ | $R_d$ | $R_e$ |
|---|---|---|---|---|---|
| 1-32 | (t)$C_4H_9$ | (t)$C_4H_9$ | H | H | H |
| 1-33 | (t)$C_4H_9$ | (t)$C_4H_9$ | H | $CH_3$ | H |
| 1-34 | (t)$C_4H_9$ | (t)$C_4H_9$ | (t)$C_4H_9$ | H | (t)$C_4H_9$ |
| 1-35 | (t)$C_4H_9$ | (t)$C_4H_9$ | (t)$C_4H_9$ | OH | (t)$C_4H_9$ |
| 1-36 | (t)$C_4H_9$ | H | H | H | H |
| 1-37 | (t)$C_5H_{11}$ | (t)$C_5H_{11}$ | H | H | H |
| 1-38 | (t)$C_5H_{11}$ | H | H | H | H |
| 1-39 | (t)$C_4H_9$ | $CH_3$ | H | H | H |
1-40
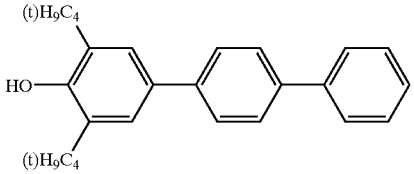
1-41
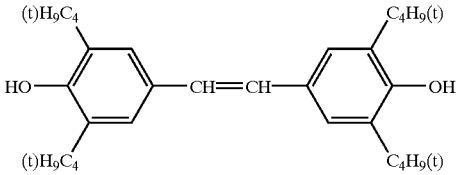
1-42
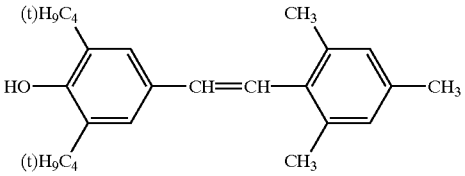

-continued
1-43
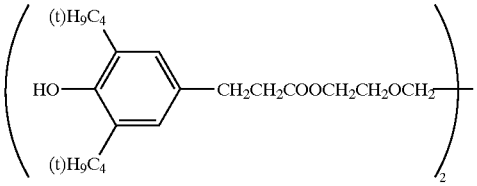
1-44
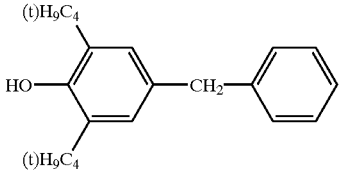
1-45
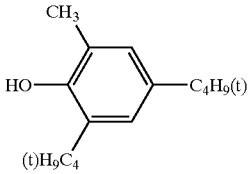
1-46
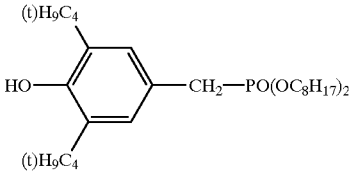
1-47
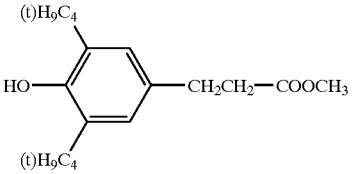
1-48
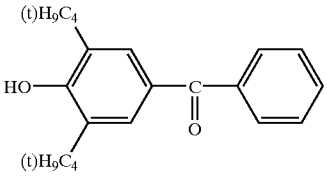
1-49
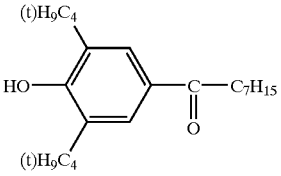
1-50
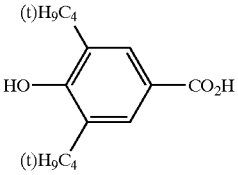

-continued
1-51
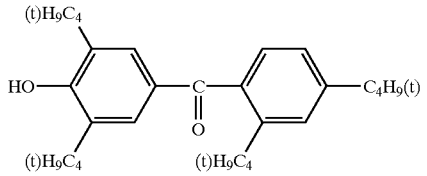
1-52
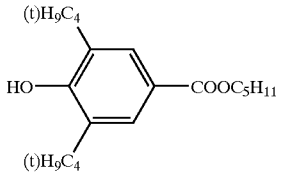
1-53
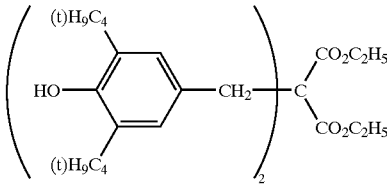
1-54
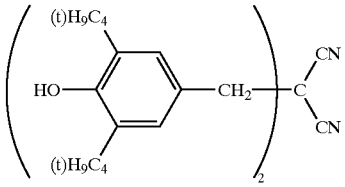
1-55
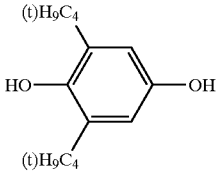
1-56
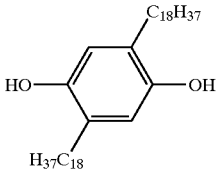
1-57
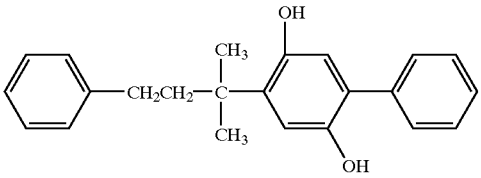
1-58
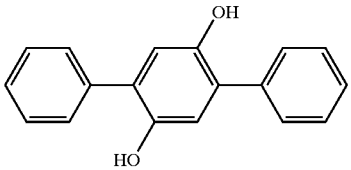

-continued
1-59
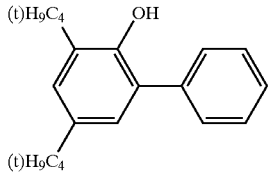
1-60
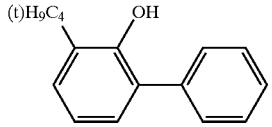
1-61
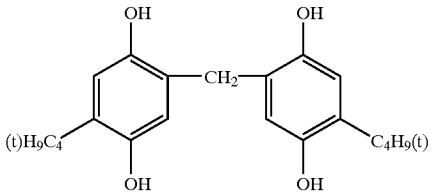
1-62
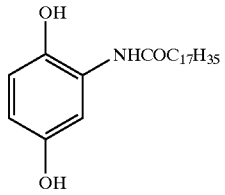
1-63
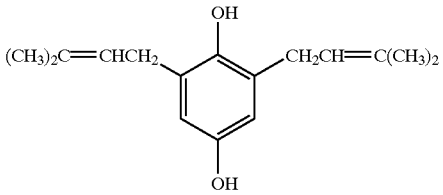
(2) Examples of compound having a hindered amine structure
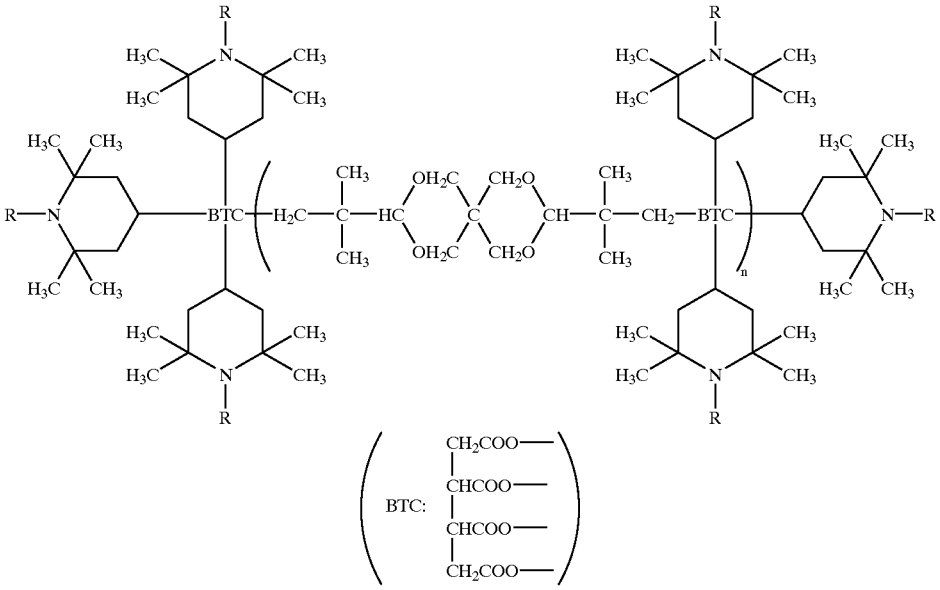

-continued
2-3
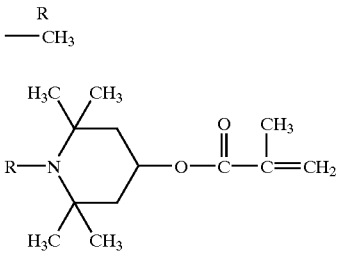
2-4
2-5
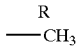
2-6
2-7
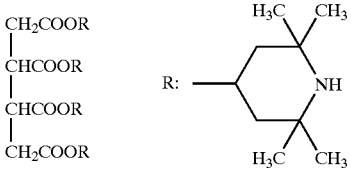
2-8
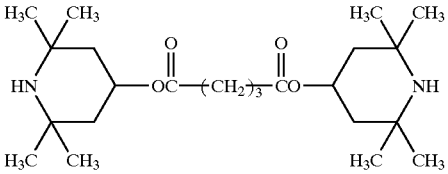
2-9
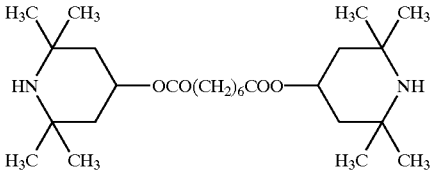
2-10
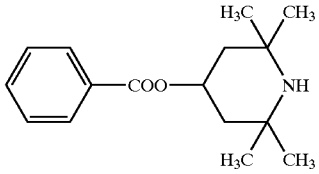
2-11
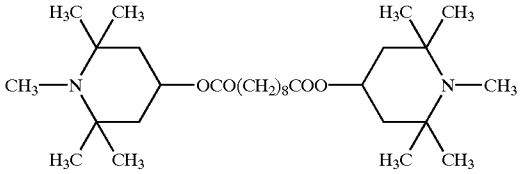
2-12
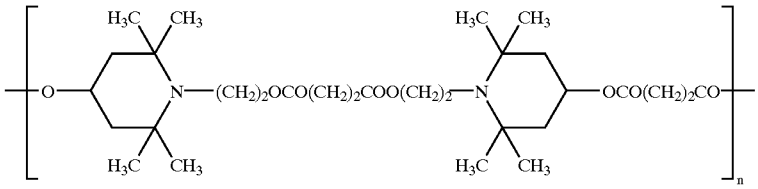
2-13
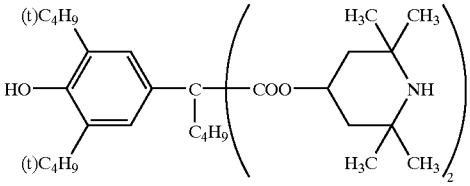
2-14
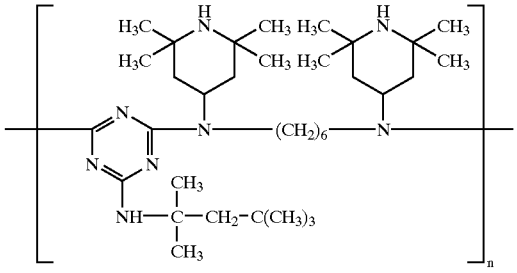

-continued
2-15
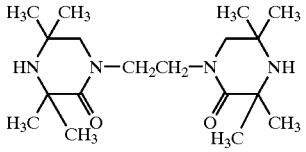
2-16
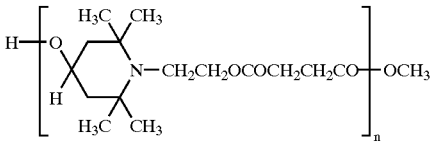
2-17
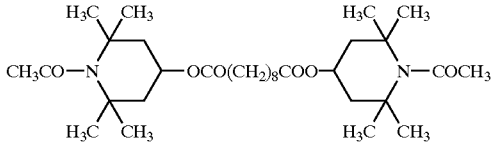
2-18
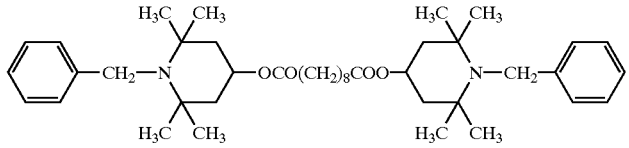
2-19
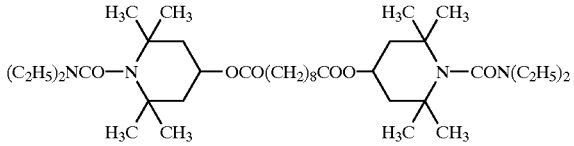
2-20
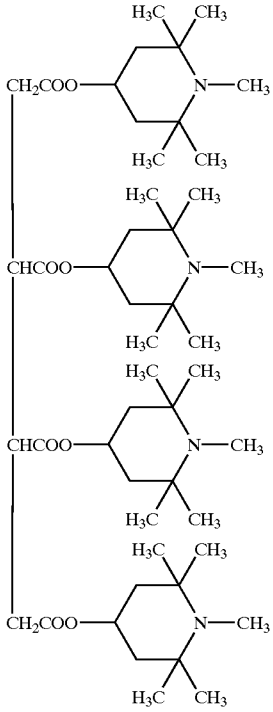
2-21
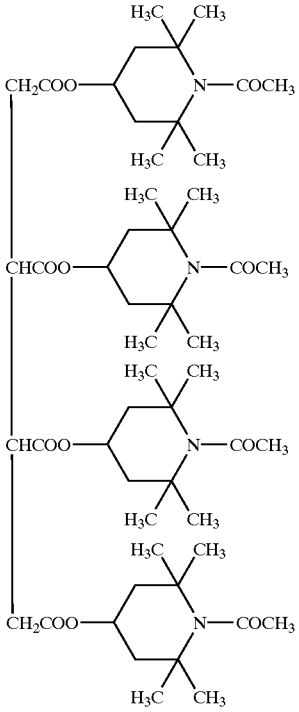

-continued
2-22
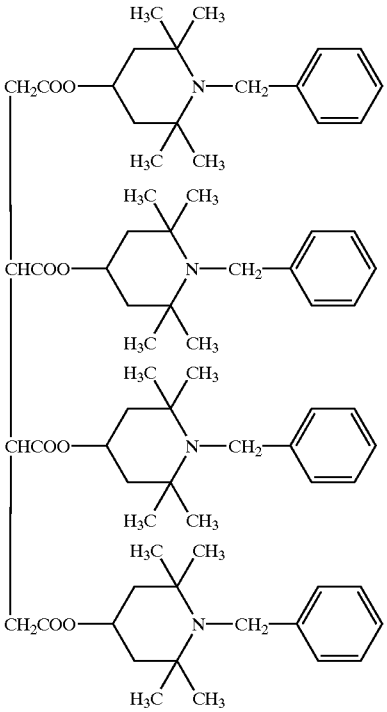
2-23
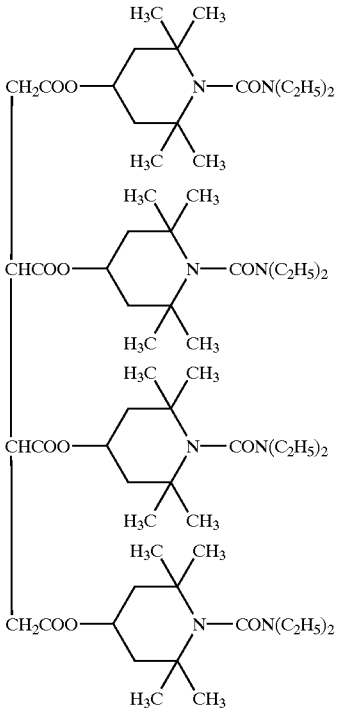
2-24
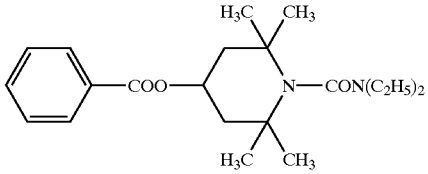
2-25
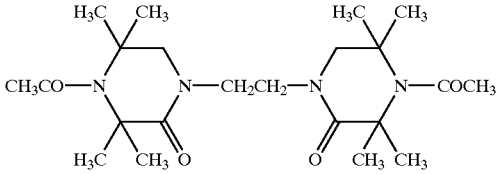
2-26
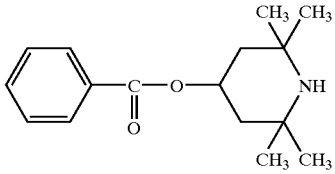
2-27
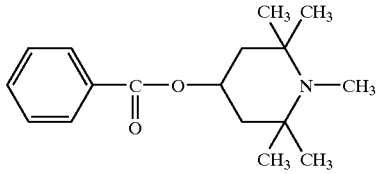
2-28
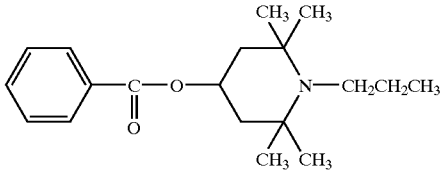
2-29
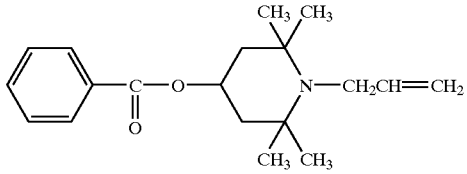
2-30
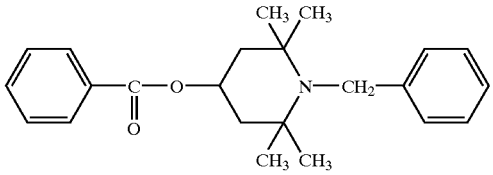
2-31
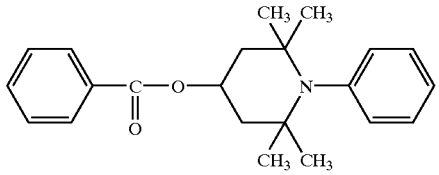
2-32
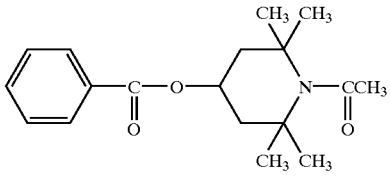
2-33
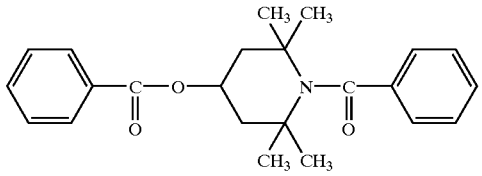

-continued
2-34
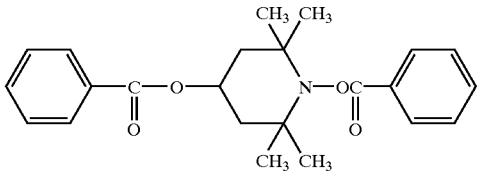
2-35
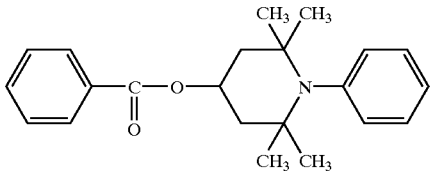
2-36
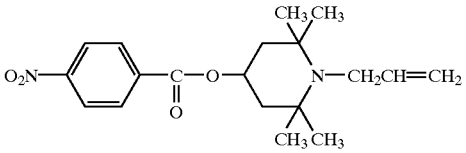
2-37
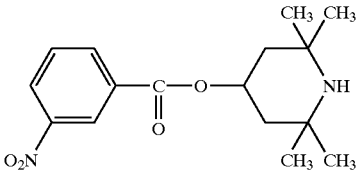
2-38
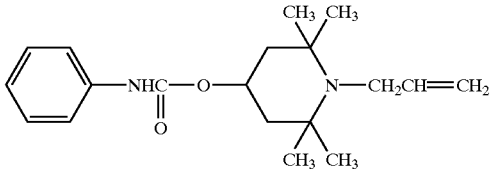
2-39
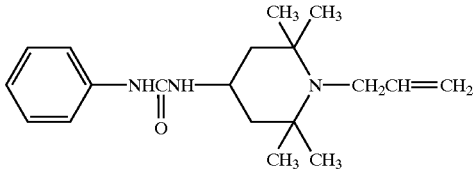
2-40
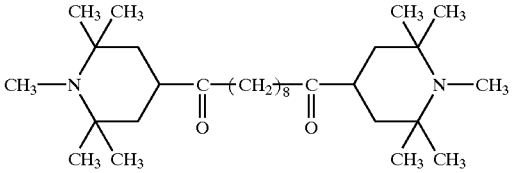
2-41
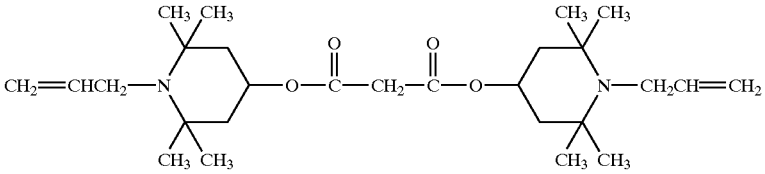
2-42
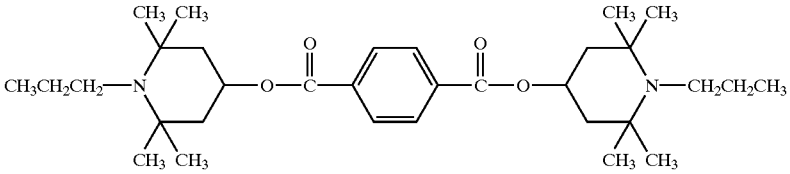
2-43
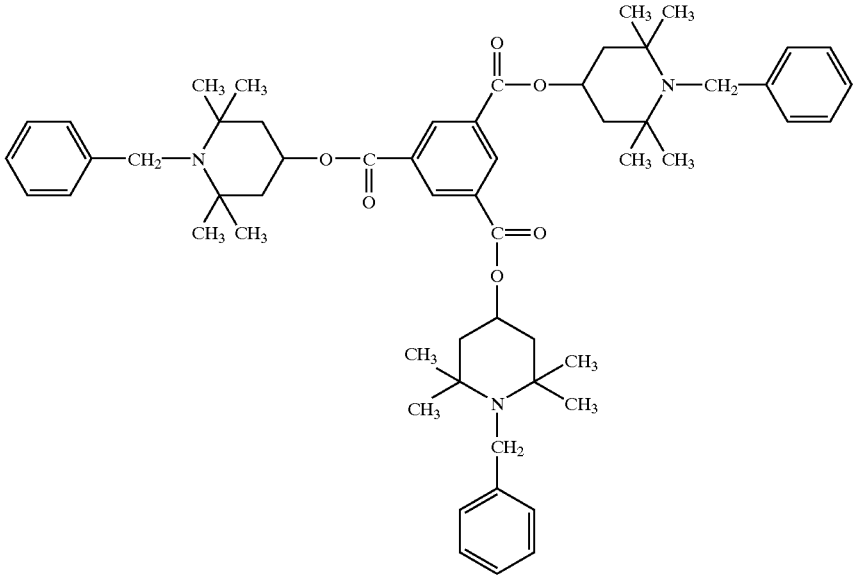

(3) Examples of compound having both of a hindered phenol structure and a hindered amine structure
3-1
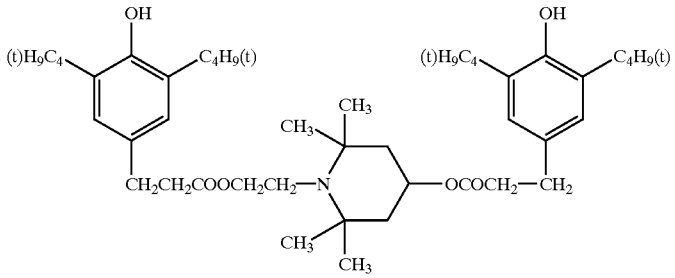
3-2
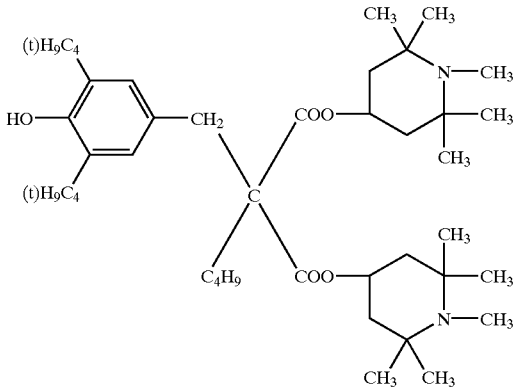
3-3
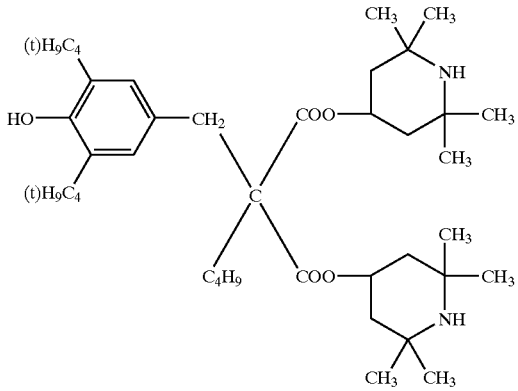
3-4
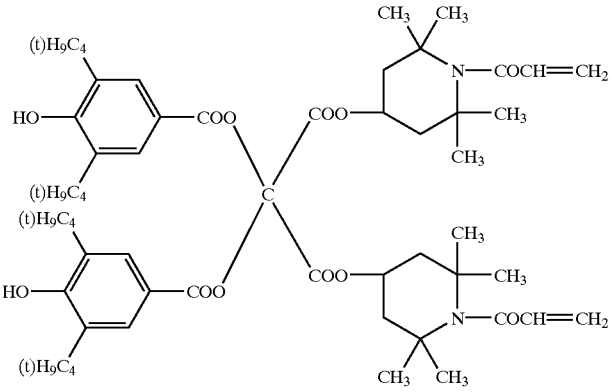
3-5
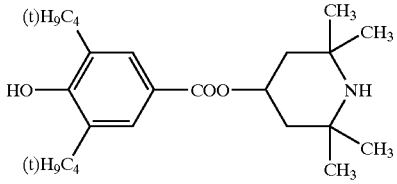
3-6
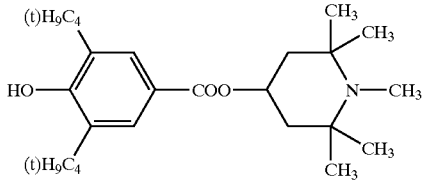
3-7
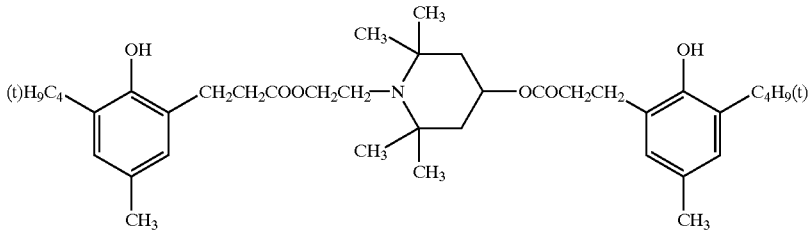

-continued 3-8

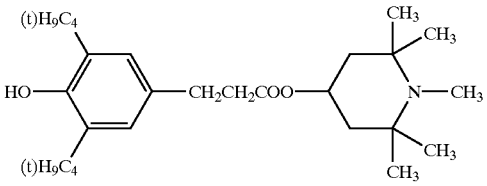

3-9

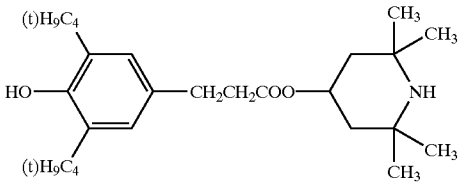

3-10

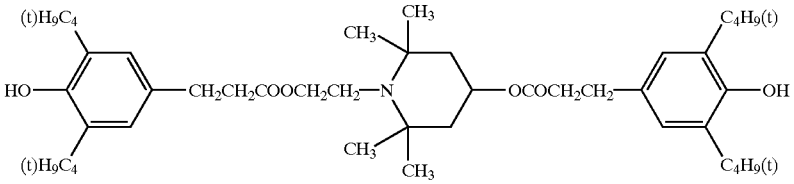

(4) Examples of organic phosphorous type compound

Typical examples of the compound represented by the formula of RO—P(OR)—OR are shown below. In the above formula, R is a hydrogen atom, an alkyl group, an alkenyl group or an aryl group, each of these groups may be substituted or unsubstituted.

4-1

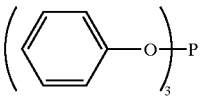

4-2

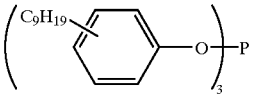

$(C_2H_5O)_3P$ 4-3

$(C_{10}H_{21}O)_3P$ 4-5

$(C_8H_{17}O)_3P$ 4-4

$(C_{13}H_{27}O)_3P$ 4-6

4-7

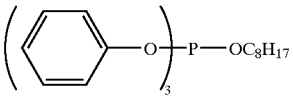

4-8

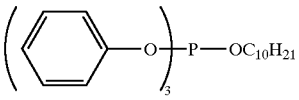

4-9

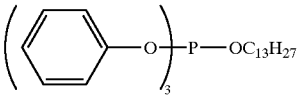

4-10

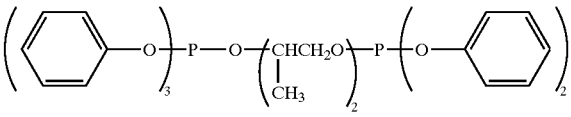

-continued 4-11

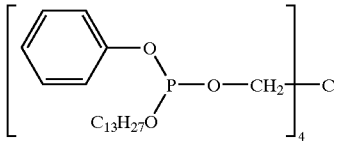

4-12

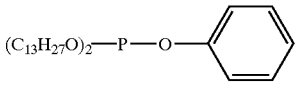

4-13

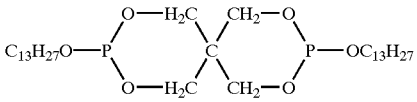

4-14

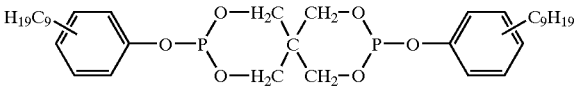

$(C_{18}H_{35}O)_3P$ 4-15

4-16

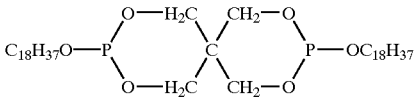

4-17

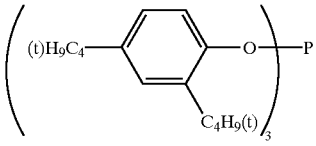

4-18

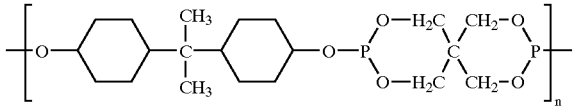

(5) Organic sulfur compound

Typical examples of the compound represented by formula of R—S—R are shown below. In the formula, R is a hydrogen atom, an alkyl group, an alkenyl group or an aryl group, each of these groups may be substituted or unsubstituted.

$(C_8H_{17}OCOCH_2CH_2)_2S$ 5-1

$(C_{12}H_{25}OCOCH_2CH_2)_2S$ 5-3

$(C_{18}H_{37}OCOCH_2CH_2)_2S$ 5-5

$(C_{10}H_{21}OCOCH_2CH_2)_2S$ 5-2

$(C_{14}H_{29}OCOCH_2CH_2)_2S$ 5-4

5-6

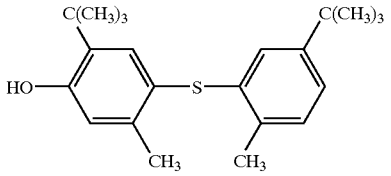

Examples of antioxidant available on the market include the followings.

Hindered phenol type antioxidant: ILGANOX 1076, ILGANOX 1010, ILGANOX 1098, ILGANOX 245, ILGANOX 1330, ILGANOX 3114, ILGANOX 1076 and 3, -5-di-t-butyl-4-hydroxybiphenyl.

Hindered amine type antioxidant: SANOL LS2626, SANOL LS765, SANOL LS770, SANOL LS744, TINUVIN 144, TINUVIN 622LD, MARK LA57, MARK LA67, MARK LA62, MARK LA68 and MARK LA63.

The constitution of the invention is described below.

The layer structure of the electrophotographic photoreceptor is not particularly limited. However, it is mentioned that the preferred structure is such that the resin layer of the present invention is applied onto a photosensitive layer composed of a charge generating layer, a charge transport layer, or a charge generating-charge transport layer.

The charge generating materials (CGM) incorporated into the photosensitive layer of the present invention may be employed individually or in combination with a suitable binder resin to form a resin layer. The representative examples of the charge generating materials include, for example, pyrylium dyes, thiopyrylium dyes, phthalocyanine pigments, anthanthrone pigments, dibenzpyrenequinone pigments, pyranthrone pigments, azo pigments, trisazo pigments, disazo pigments, indigo pigments, quinacridone pigments, cyanine dyes etc.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benz imidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

In the present invention, the ratio of the charge generating material in the charge generating layer to the binder resin is preferably between 1:5 and 5:1 in terms of weight ratio. Further, the thickness of the charge generating layer is preferably no more than 5 $\mu$m, and is more preferably between 0.05 and 2 $\mu$m.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 3:1 and 1:3 in terms of weight ratio.

The thickness of the charge transport layer is preferably between 5 and 50 $\mu$m, and is more preferably between 10 and 40 $\mu$m. Furthermore, when a plurality of charge transport layers are provided, the thickness of the upper charge transport layer is preferably no more than 10 $\mu$m, and is preferably less than the total layer thickness of the charge transport layer provided under the upper layer of the charge transport layer.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate; dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, electrically conductive supports for use in the electrophotographic image carrier of the present invention include:

1) metal plates such as aluminum, stainless steel, etc.,
2) those prepared by laminating or evaporating a thin metal layer such as aluminum, palladium, gold, and the like onto a support such as paper, plastic film, etc.,
3) those prepared by coating or evaporating a layer composed of electrically conductive compounds such as an electrically conductive polymer, indium oxide, tin oxide, etc.

Metal material such as aluminum, copper, brass, steel, stainless steel, or plastic material, which are formed in belt or drum shape are mainly used for the electric conductive support employed in the invention. Aluminum which is advantageous in cost and workability is employed preferably among these, and thin aluminum pipe formed in a cylinder shape by extruding or drawing process are frequently employed.

The electric conductive support having sealing processed alumite coating at the surface may employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the: photosensitive layer, as well as to achieve uniform coating, the spray coating method or the circular amount control type coating method (being a circular slide hopper type as its representative example) is preferably employed. Further, the above-mentioned spray coating is, for example, detailed in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (NYLON 6, NYLON 66, NYLON 610, copolymerized NYLON, alkoxymethylated NYLON, etc.), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 μm, and is most preferably between 0.1 and 5 μm.

In addition, the shape of the support may be a drum, sheet or belt, and is preferably optimum for the electrophotographic apparatus to which the support is applied.

The electrophotographic image carrier of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

Figure 2:
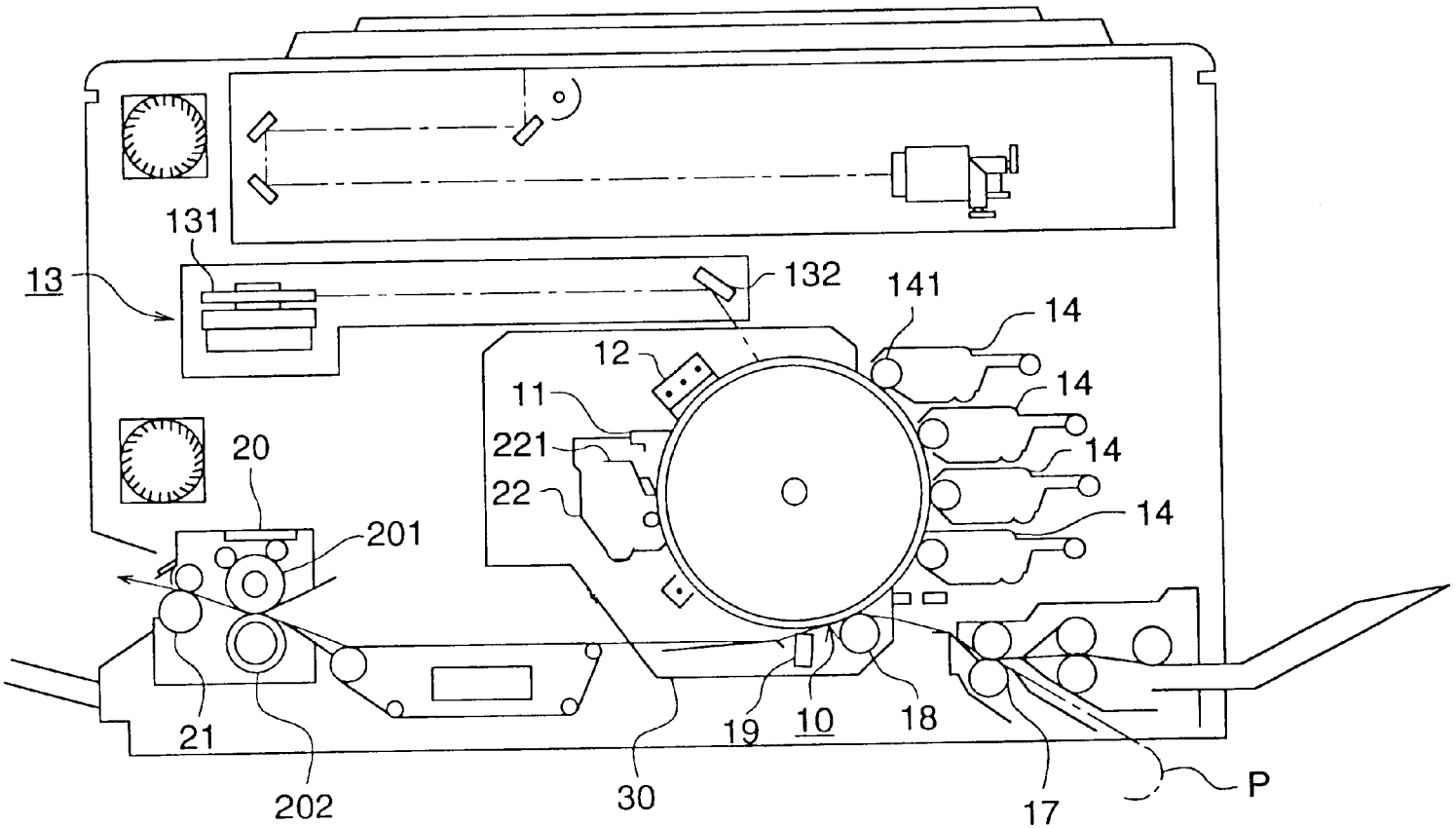
FIG. 2 shows the cross section of an image forming apparatus according to the invention.

FIG. 2 shows a cross-sectional view of an image forming apparatus comprising the electrophotographic image carrier of the present invention.

In FIG. 2, reference numeral 10 is a photoreceptor drum (a photosensitive body) which is an image holding body. The image carrier is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 11 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 2 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 10, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means, which is not shown in the figure, so as to form a layer having a thickness of 100 to 600 μm on the development sleeve, and conveyed to a development zone to achieve development. At the time, development is generally carried out by applying direct current and/or alternative current bias voltage to the gap between the photoreceptor drum 10 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 10.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 10 in synchronized transfer timing, and multicolor images are simultaneously transferred onto the recording sheet which is appropriately placed.

Subsequently, the recording sheet is subjected to charge elimination employing separation brush (in the separation unit) 19 which is brought into pressure contact at almost the same time when the transfer roller is brought into pressure contact, is separated from the circumferential surface of the photoreceptor drum 10, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 10 and are prepared for the subsequent formation of a new toner image.

On the other hand, the photoreceptor drum 10, from which the recording sheet P has been separated, is subjected to removal and cleaning of the residual toner through pressure contact of the blade 221 of cleaning unit 22, is again subjected to charge elimination employing the exposure section 11, subjected to recharging employing the charging unit 12, and subjected to a subsequent image forming process. Further, when color images are formed upon being superimposed on the image carrier, the above-mentioned blade 221 is immediately withdrawn after cleaning the photoreceptor surface of the photoreceptor drum.

Further, reference numeral 30 is a detachable cartridge in which an image carrier, a transfer unit, a separation unit, and a cleaning unit are integrated.

The present electrophotographic image forming apparatus is constituted in such a manner that components such as the above-mentioned image carrier, development unit, cleaning unit and the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with an image carrier, and it may be arranged to be detachable employing a guiding means such as a rail in the apparatus main body.

There are two types of process cartridge, in general, of an integral type cartridge and a separated type cartridge illustrated as follows. The integral type of cartridge is composed of at least one of a charging unit, an image exposure unit, a development unit, a transfer or separation unit, and a cleaning unit in combination with the image carrier integrally, and the cartridge is detachable to the main body. The separate type cartridge is composed of a charging unit, an image exposure unit, a development unit, a transfer or separation unit, and a cleaning unit separately from the image carrier, and is detachable to the main body, and is unified to the main body when composed within the main body integrally. The process cartridge of the invention may apply to both types of cartridges.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

EXAMPLES

The present invention will now be detailed with reference to examples below, however, the embodiments of the present invention are not limited to these examples.

Image carriers were prepared in the following way.

Example 1–5 and 7–9

An image carrier was prepared as described below.

<Interlayer>

| | |
|---|---|
| Polyamide resin (AMILAN CM-8000, manufactured by Toray Co.) | 60 g |
| Methanol | 1,600 ml |
| 1-Butanol | 400 ml |

were mixed and dissolved to prepare an interlayer coating solution. The resulting coating solution was applied onto a cylindrical aluminum base body, employing an immersion coating method, and dried at room temperature to form a 0.3 Am thick interlayer.

<Charge Generating Layer>

| | |
|---|---|
| Titanylphthalocyanine | 60 g |
| Silicone resin solution (15% KR5240 xylene-butanol solution, manufactured by Shin-Etsu Kagaku Kogyo Co.) | 700 g |
| Butanone | 2,000 ml |

were mixed and dispersed for 10 hours employing a sand mill to prepare a charge generating layer coating composition. The resulting coating composition was applied onto the above-mentioned interlayer, employing an immersion coating method, to form a 0.2 $\mu$m thick charge generating layer.

<Charge Transport Layer>

| | |
|---|---|
| Charge transport material (D1) | 200 g |
| Bisphenol Z type polycarbonate (IUPILON Z300, manufactured by Mitsubishi Gas Kagaku Co.) | 300 g |
| 1,2-dichloroethane | 2,000 ml |

were mixed and dissolved to prepare a charge transport coating composition. The resulting coating composition was applied onto the above-mentioned charge generating layer employing an immersion coating method, to form a 20 $\mu$m thick charge transport layer.

<Protective Layer>

Molecular Sieve 4A was added to 10 weight parts of a polysiloxane resin (containing one weight percent of a silanol group) comprised of 80 mole percent of the methylsiloxane unit and 20 mole percent of the methylphenylsiloxane unit, the resulting mixture was left undisturbed for 15 hours, and then dehydrated. The resulting resin was dissolved in 10 weight parts of toluene, and 5 weight parts of methyltrimethoxysilane, and 0.2 weight part of dibutyl tin acetate were added to the resulting solution to form a uniform solution.

Added to the resulting solution were 6 weight parts of dihydroxymethyltriphenylamine (Exemplified Compound T-1) and then mixed. The resulting solution was applied to the resulting coating as a 1 $\mu$m thick protective layer and subsequently dried at 120° C. for one hour to prepare the image carrier of Example 1–5 and 7–9.

D1

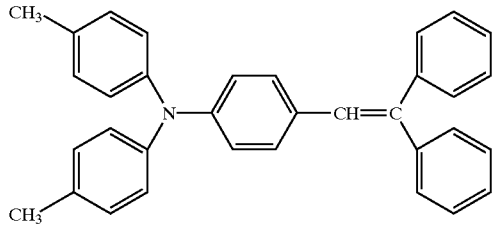

Example 10

An image carrier was prepared in the same way as Example 1 except that dihydroxymethyltriphenylamine in the protective layer was replaced by 4-[2-triethoxysilyl) ethyl]triphenylamine. Example 11

An image carrier was prepared in the same way as Example 1 except that an amount of the anti-oxidant was changed from 0.3 wt. % to 0.03 wt. %.

Comparative Example 1

An image carrier was prepared in the same way as Example 1 except that the anti-oxidant was not employed.

Comparative Example 2

An image carrier was prepared in the same manner as in Example 10 except that no anti-oxidant was used.

Comparative Example 3

An image carrier was prepared in the same manner as in Example 1 except that dihydroxymethyltriphenylamine (Exemplified compound T-1) in the protective layer was omitted. Separation of the anti-oxidant was observed in thus prepared image carrier and black spots were formed at the initial period of the use of the image carrier.

Evaluation of the Properties

The evaluation was carried out by installing the image carrier on a digital image forming apparatus.

To prepare a machine to be used for the evaluation, a digital copy machine KONICA 7050, manufactured by Konica Corporation, was modified so as to control the exposing amount suitable, and each of the image carriers to be evaluated was installed in the machine. The initial charge potential was set at −650 V. Copying operations was repeated 50,000 times using A4 size paper and the variation of the potential at the exposed area VL, the potential at the unexposed area VH, the worn amount of the layer thickness and the image quality were evaluated after the copying of 50,000 sheets.

As is shown in Table 1, the image carriers prepared in examples 1 through 5 and 7 through 11 did not form any fault such as fogging, blurring of image, flowing of image, filming, scratches and black spots, and the reflective density at the solid blackened area was not less than 1.2 which was sufficiently high. Thus, images with a high resolution were obtained. Besides, in the image carriers of Comparative Examples 1 through 3, both of the potential variation and image properties were bad and it was found that these image carriers were unsuitable for practical use.

The image density by absolute density was measured at the solid black image using a densitometer RD-918, manufactured by Macbeth Co., Ltd., and the fogging was visually evaluated at the white area of image of the first copy and the 50,000th copy. The blurring of the image was evaluated by visual.

Image Density

A: 1.2 or more: Good

B: Less than 1.2 to 0.8: Acceptable for practical use

C: Less than 0.8: Unsuitable for practical use

Fogging

A: No fogging was observed

B: Fogging was occasionally observed but the level of fogging was acceptable for practical use.

C: Fogging was observed continuously.

Blurring of Image

A: Blurred image was observed on not more than 5 sheets among the 50,000 sheets.

B: Blurred image was observed on 6 to 20 sheets among the 50,000 sheets.

C: Blurred image was observed on 21 or more sheets among the 50,000 sheets.

The diameter and the number of black spots were measured by an image analysis apparatus OMUNICON 3000, manufactured by Shimadzu Seisakusho Co., Ltd., for evaluating the formation of black spots. The evaluation was carried out based on the number of black spots having a diameter of not less than 0.1 mm per 100 $cm^2$. The norm of the evaluation was as follows.

Number of Black Spot of 0.1 mm

A: Not more than 1/100 $cm^2$: Good

B: 2 to 3/100 $cm^2$: Acceptable for practical use

C: 4 or more/100 $cm^2$: Unsuitable for practical use

The wearing amount of the layer thickness was measured based on the difference between the layer thickness at the first copy and after 50,000th copy.

Results are shown in Table 1.

TABLE 1

| | Anti-oxidant | Potential variation ΔVH(V) | Potential variation ΔVL(V) | Wearing amount of photoreceptor | Image density | Fogging | Blurring of image | Black spot and others |
|---|---|---|---|---|---|---|---|---|
| Example 1 | 1-1 | 28 | 25 | Not more than 0.1 | A | A | A | B |
| Example 2 | 1-7 | 35 | 38 | Not more than 0.1 | A | A | A | B |
| Example 3 | 1-32 | 21 | 21 | Not more than 0.1 | A | A | A | B |
| Example 4 | 2-32 | 25 | 30 | Not more than 0.1 | A | A | A | A |
| Example 5 | 3-1 | 20 | 28 | Not more than 0.1 | A | A | A | A |
| Example 7 | 4-1 | 79 | 34 | Not more than 0.1 | A | B | B | B |
| Example 8 | 1-8/ 4-1 = 1/1 wt. pt | 21 | 21 | Not more than 0.1 | A | A | A | B |
| Example 9 | 5-6 | 69 | 44 | Not more than 0.1 | A | B | B | B |
| Example 10 | 1-1 | 65 | 86 | 0.4 | A | B | B | B |
| Example 11 | 1-1 | 45 | 56 | Not more than 0.1 | A | A | A | B |

TABLE 1-continued

| | Anti-oxidant | Potential variation ΔVH(V) | Potential variation ΔVL(V) | Wearing amount of photoreceptor | Image density | Fogging | Blurring of image | Black spot and others |
|---|---|---|---|---|---|---|---|---|
| Example 12 | 1-35 | 48 | 53 | Not more than 0.1 | A | A | A | B |

Table 1 shows that Examples 1 through 5 and 7 through 11 according to the invention are all sufficient in all the properties, contrary to that Comparative examples 1, 2 and 3 are inferior in the potential variation or image quality.

Example 12

The following charge transporting layer was coated on a charge generating layer prepared in the same manner as in Example 1 to prepare an image carrier.

| | |
|---|---|
| Charge transporting substance (Exemplified Compound T-1) | 200 g |
| Methyltrimethoxysilane | 300 g |
| Hindered phenol compound (1-35) | 1 g |
| Colloidal silica (39% methanol solution) | 8 g |
| 1-butanol | 50 g |
| 1% acetic acid | 50 g |
| Aluminumtetraacetyl acetate | 2 g |

The above components were mixed and dissolved to prepare a charge transporting layer coating solution. The coating solution was coated on the charge generating layer by an immersing coating method. The coated layer was hardened by heating for 2 hours at 110° C. Thus a charge transporting layer having a thickness of 12 μm was formed.

The evaluation was carried out according to the above-mentioned.

Comparative Example 4

An image carrier was prepared and evaluated in the same manner as in Example 12 except that charge transporting substance T-1 was replaced by charge transporting substance D2.

Results are also shown in Table 1. Table 1 shows that, in the comparative image carrier, formation of black spots caused by the separation of the charge transporting substance or the anti-oxidant, increasing of wearing amount and filming were occurred and the durability and the electrophotographic property of the comparative example were degraded.

Example 21

<Interlayer>

| | |
|---|---|
| Polyamide resin (AMILAN CM-8000, manufactured by Toray Co.) | 60 g |
| Methanol | 1,600 ml |
| 1-Butanol | 400 ml |

were mixed and dissolved to prepare an interlayer coating solution. The resulting coating solution was applied onto a cylindrical aluminum base body, employing an immersion coating method, and dried at room temperature to form a 0.3 μm thick interlayer.

<Charge Generating Layer>

| | |
|---|---|
| Y Titanylphthalocyanine | 60 g |
| Silicone resin solution (15% KR5240 xylene-butanol solution, manufactured by Shin-Etsu Kagaku Kogyo Co.) | 700 g |
| 2-Buthanone | 2,000 ml |

were mixed and dispersed for 10 hours employing a sand mill to prepare a charge generating layer coating composition. The resulting coating composition was applied onto the above-mentioned interlayer, employing an immersion coating method, to form a 0.2 μm thick charge generating layer.

<Charge Transport Layer>

| | |
|---|---|
| Charge transport material D2 | 200 g |
| Bisphenol Z type polycarbonate (IUPILON Z300, manufactured by Mitsubishi Gas Kagaku Co.) | 300 g |
| 1,2-dichlorethane | 2,000 ml |

were mixed and dissolved to prepare a charge transport coating composition. The resulting coating composition was applied onto the above-mentioned charge generating layer employing an immersion coating method, to form a 20 μm thick charge transport layer.

C1

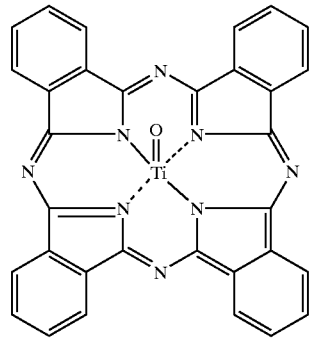

D2

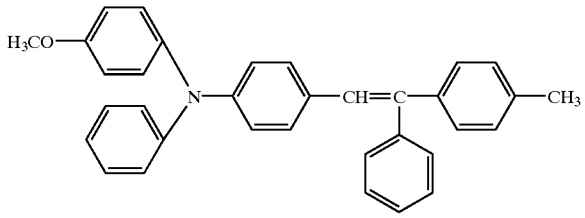

<Adhering Layer>

| | |
|---|---|
| Silyl acrylate (PC-7A, manufactured by Shin'etsu Kagaku Kogyo Co., Ltd.) | 60 g |
| 2-butanone | 2000 ml |

The above components were mixed and dissolved to prepare an adhering layer coating solution. The coating solution was coated on the charge transporting layer and subjected to a heating treatment for 30 minutes at 100° C. so as to form an adhering layer having a thickness of 0.3 μm.

<Protective Layer>

A methanol solution of a polysiloxane composed of 80 mole-% of methylsiloxane unit and 20 mole-% of methylphenylsiloxane unit was dehydrated by standing for 15 hours in the presence of Molecularsheave 4A. Ten parts by weight of this solution was dissolved in 10 parts by weight of toluene, then 1 part by weight of methyltrimethoxysilane and 0.2 parts by weight of dibutyl tin acetate were added to the solution to prepare an uniform solution.

The solution was coated so as to form a protective layer having a dry thickness of 1 μm, and the coated layer was hardened by heat for 1 hour at 120° C. Thus image carrier of Example 21 was prepared. A plane heater in which a Nichrome wire was sandwiched was inserted in the interior of the electric conductive substrate of the photoreceptor drum so that the drum can be heated from inside of the drum.

Example 22

An image carrier was prepared in the same manner as in Example 21 except that 0.5 parts by weight of colloidal silica was added to the protective layer coating solution.

A sample was prepared in the same manner as in Example 21 till the adhering layer. On the other hand, a solution was prepared by uniformly dissolving 60 parts by weight of organic silicon compound KP-85 (Shin'etsu Kagaku Kogyo Co., Ltd.) available on the market in 60 parts by weight of 2-propanol. This solution was coated on the adhering layer so as to form a surface protective layer having a dry thickness of 1 μm, and the coated layer was dried for 1 hour at 110° C. Thus an image carrier was prepared. A plane heater in which a Nichrome wire was sandwiched was inserted in the interior of the electric conductive substrate of the photoreceptor drum so that the drum can be heated from inside of the drum.

Example 24

A sample was prepared in the same manner as in Example 21 till the adhering layer. On the other hand, a solution was prepared by uniformly dissolving 60 parts by weight of organic silicon compound KP-854 (Shin'etsu Kagaku Kogyo Co., Ltd.) available on the market in 60 parts by weight of 2-propanol. This solution was coated on the adhering layer so as to form a surface protective layer having a dry thickness of 1 μm, and the coated layer was dried for 1 hour at 100° C. Thus an image carrier was prepared. A plane heater in which a Nichrome wire was sandwiched was inserted in the interior of the electric conductive substrate of the photoreceptor drum so that the drum can be heated from inside of the drum.

Example 25

A sample was prepared in the same amount as in Example 21 till the adhering layer. On the other hand, a solution was prepared by uniformly dissolving 60 parts by weight of organic silicon compound X-40-2269 (Shinletsu Kagaku Kogyo Co., Ltd.) available on the market in 60 parts by weight of 2-propanol. This solution was coated on the adhering layer so as to form a surface protective layer having a dry thickness of 1 μm, and the coated layer was dried for 1 hour at 100° C. Thus an image carrier was prepared. A plane heater in which a Nichrome wire was sandwiched was inserted in the interior of the electric conductive substrate of the photoreceptor drum so that the drum can be heated from inside of the drum.

Example 26

A sample was prepared in the same manner as in Example 21 till the adhering layer. On the other hand, a solution was prepared by uniformly dissolving 60 parts by weight of organic silicon compound X-40-2239 (Shin'etsu Kagaku Kogyo Co., Ltd.) available on the market in 60 parts by weight of 2-propanol. This solution was coated on the adhering layer so as to form a surface protective layer having a dry thickness of 1 μm, and the coated layer was dried for 1 hour at 110° C. Thus, an image carrier was prepared. A plane heater in which a Nichrome wire was sandwiched was inserted in the interior of the electric conductive substrate of the photoreceptor drum so that the drum can be heated from the inside of the drum.

Comparative Example 21

A photoreceptor was prepared in the same manner as in Example 21 except that the adhering layer and the surface protective layer were omitted.

Evaluation of Characteristics

1. Evaluation of Image

To prepare a machine to be used for the evaluation, a digital copy machine KONICA 7050, manufactured by Konica Corporation, was modified so as to control the exposing amount to suitable, and the image carriers of Examples 21 to 26 and Comparative Example 21 were each installed in the machine. The initial charge potential was set at −650 V. Copy operations of 10,000 sheets were carried out under a high humid and temperature condition (30° C., 80° RH) while holding the temperature of the image carrier at 40° C. Images sampled at the initial time of copying and after 10,000 copies were evaluated.

A: No defect is observed.

B: Acceptable for practical use even though the resolving power is slightly lowered.

C: Unsuitable for practical use since the resolving power is lowered in a part of the image.

D: Not usable for practical use since image flowing is occurred.

2. Evaluation of anti-wearing ability

The wearing amount of layer thickness after copying 10,000 sheets was measured for the evaluation.

Results are shown in Table 1.

Moreover, the evaluations were carried out under the following conditions of Comparative Examples 22 to 24 and the results thereof are shown in Table 2.

Comparative Example 22

In the same manner as Example 21, 10,000 sheets of copies were carried out except that the heating of image carrier while copying operation was omitted. Evaluation was performed in the same manner as in Example 21.

Comparative Example 23

In the same manner as Example 22, 10,000 sheets of copies were carried out except that the heating of image carrier while copying operation was omitted. Evaluation was performed in the same manner as in Example 22.

Comparative Example 24

In the same manner as Comparative Example 21, 10,000 sheets of copies were carried out except that the heating of image carrier while copying operation was omitted. Evaluation was performed in the same manner as in Comparative Example 21.

TABLE 2

| | Wearing of layer thickness (μm) | Initial image | Image after 10,000 sheets copying |
|---|---|---|---|
| Example 21 | 0.38 | B | B |
| Example 22 | 0.21 | B | B |
| Example 23 | 0.16 | B | B |
| Example 24 | 0.28 | B | B |
| Example 25 | .00.23 | A | A |
| Example 26 | 0.24 | A | A |
| Comparative example 21 | 2.44 | B | C |
| Comparative example 22 | 0.66 | C | D |
| Comparative example 23 | 0.30 | C | D |
| Comparative example 24 | 2.35 | B | C |

The above-mentioned results show that the surface wearing and the image quality after repeated use can be improved by controlling the temperature of the image carrier (photoreceptor drum) within the optimal range. Contrary, any effect of the heating is not obtained when the photoreceptor having no surface protective layer as is shown in the results of Comparative Examples 21 and 24.

Example 27

A methanol solution of a polysiloxane composed of 80 mole-% of methylsiloxane unit and 20 mole-% of methylphenylsiloxane unit was dehydrated by standing for 15 hours in the presence of Molecularseave 4A. Ten parts by weight of this solution was dissolved in 10 parts by weight of toluene, then 1 part by weight of methyltrimethoxysilane and 0.2 parts by weight of dibutyl tin acetate were added to the solution to prepare an uniform solution.

To the solution, 6 parts by weight of dihydroxymethyltriphenylamine and 0.3 parts by weight of hindered amine (exemplified Compound 2-1) were added and mixed. The solution was coated as to form a protective layer having a dry thickness of 1 μm, and the coated layer was hardened by heat for 1 hour at 120° C. Thus, image carrier of Example 27 was prepared. A plane heater in which a Nichrome wire was sandwiched was inserted in the interior of the electric conductive substrate of the photoreceptor drum so that the drum can be heated from inside of the drum.

Example 28

An image carrier was prepared in the same manner as in Example 27 except that 0.5 parts by weight of colloidal silica was added to the surface protective layer coating solution.

Example 29

A solution was prepared by uniformly dissolving 60 parts by weight of organic silicon compound KP-85 (Shin'etsu Kagaku Kogyo Co., Ltd.) available on the market in 60 parts by weight of 2-propanol. Moreover, 6 parts by weight of dihydroxymethyltriphenylamine was added to the solution and dissolved to form a uniform solution. This solution was coated on the charge transporting layer of Example 21 so as to form a surface protective layer having a dry thickness of 1 μm, and the coated layer was dried for 1 hour at 120° C. Thus an image carrier was prepared. A plane heater in which a Nichrome wire was sandwiched was inserted in the interior of the electric conductive substrate of the photoreceptor drum so that the drum can be heated from inside of the drum.

Example 30

A solution was prepared by uniformly dissolving 60 parts by weight of organic silicon compound KP-854 (Shin'etsu Kagaku Kogyo Co., Ltd.) available on the market in 60 parts by weight of 2-propanol. Moreover, 6 parts by weight of dihydroxymethyltriphenylamine was added to the solution and dissolved to form a uniform solution. This solution was coated on the charge transporting layer of Example 21 so as to form a surface protective layer having a dry thickness of 1 μm, and the coated layer was dried for 1 hour at 120° C. Thus an image carrier was prepared. A plane heater in which a Nichrome wire was sandwiched was inserted in the interior of the electric conductive substrate of the photoreceptor drum so that the drum can be heated from inside of the drum.

Example 31

A solution was prepared by uniformly dissolving 30 parts by weight of organic silicon compound X-40-2239 (Shin'etsu Kagaku Kogyo Co., Ltd.) available on the market in 60 parts by weight of 2-propanol. Moreover, 6 parts by weight of dihydroxymethyltriphenylamine was added to the solution and dissolved to form a uniform solution. This solution was coated on the charge transporting layer of Example 21 so as to form a surface protective layer having a dry thickness of 1 μm, and the coated layer was dried for 1 hour at 100° C. Thus an image carrier was prepared. A plane heated in which a Nichrome wire was sandwiched was inserted in the interior of the electric conductive substrate of the photoreceptor drum so that the drum can be heated from inside of the drum.

Example 32

A solution was prepared by uniformly dissolving 30 parts by weight of organic silicon compound X-40-2269 (Shin'etsu Kagaku Kogyo Co., Ltd.) available on the market in 60 parts by weight of 2-propanol. Moreover, 6 parts by weight of dihydroxymethyltriphenylamine was added to the solution and dissolved to form a uniform solution. This solution was coated on the charge transporting layer of Example 21 so as to form a surface protective layer having a dry thickness of 1 μm, and the coated layer was dried for 1 hour at 100° C. Thus an image carrier was prepared. A plane heater in which a Nichrome wire was sandwiched was inserted in the interior of the electric conductive substrate of the photoreceptor drum so that the drum can be heated from inside of the drum.

Example 33

An image carrier was prepared in the same manner as in Example 27 except that dihydroxymethyltriphenylamine in the surface protective layer was replaced by 4-[2-(triethoxsilyl)-ethyl]triphenylamine.

Example 34

An image carrier was prepared in the same manner as in Example 28 except that dihydroxymethyltriphenylamine in the surface protective layer was replaced by 4-[2-(triethoxsilyl)-ethyl]triphenylamine.

Example 35

An image carrier was prepared in the same manner as in Example 27 except that the hindered amine (Exemplified Compound 3-1) in the surface protective layer was replaced by a hindered phenol (Exemplified Compound 1-32).

Example 36

An image carrier was prepared in the same manner as in Example 28 except that the hindered amine compound was omitted.

Comparative Example 25

An image carrier was prepared in the same manner as in Example 22 except that the surface protective layer was omitted.

Evaluation of Characteristics

1. Evaluation of Image

The evaluation machine was prepared by modifying a digital copy machine KONICA 7050, manufactured by Konica Corporation, so as to control the exposing amount to suitable, and the image carriers of Examples 27 to 36 and Comparative Example 25 were each installed on the machine. The initial charge potential was set at −650 V. Copy operations of 10,000 were carried out under a high humid and temperature condition (30° C., 80% RH) while holding the temperature of the photoreceptor at 40° C. Images sampled at the initial time of copying and after 10,000 copies were evaluated.

A: No defect was observed.

B: Acceptable for practical use even though the resolving power was slightly lowered.

C: Unsuitable for practical use since the resolving power was lowered in a part of the image.

D: Not usable for practical use since image flowing was occurred.

2. Evaluation of Anti-wearing Ability

The wearing amount of layer thickness after copying 10,000 sheets was measured for the evaluation.

Results are shown in Table 3.

Moreover, the evaluations were carried out under the following conditions and the results thereof are shown in Table 2.

Comparative Example 26

In the same manner as Example 27, 10,000 sheets of copies were carried out except that that the heating of photoreceptor while copying operation was omitted.

Comparative Example 27

In the same manner as Example 8, 10,000 sheets of copies were carried out except that that the heating of photoreceptor while copying operation was omitted.

Comparative Example 28

In the same manner as Example 25, 10,000 sheets of copies were carried out except that that the heating of photoreceptor while copying operation was omitted.

Comparative Example 28

In the same manner as Example 33, 10,000 sheets of copies were carried out except that that the heating of photoreceptor while copying operation was omitted.

These comparative examples were evaluated in the same manner and the results are shown in Table 3.

TABLE 3

| | Wearing of layer thickness (μm) | Initial image | Image after 10,000 sheets copying |
|---|---|---|---|
| Example 27 | 0.43 | A | A |
| Example 28 | 0.28 | A | A |
| Example 29 | 0.26 | A | A |
| Example 30 | 0.35 | A | A |
| Example 31 | 0.26 | A | A |
| Example 32 | 0.26 | A | A |
| Example 33 | 0.65 | B | B |
| Example 34 | 0.46 | B | B |
| Example 35 | 0.45 | A | A |
| Example 36 | 0.46 | B | B |
| Comparative example 25 | 2.44 | B | C |
| Comparative example 26 | 0.75 | B | B |
| Comparative example 27 | 0.57 | B | B |
| Comparative example 28 | 2.35 | B | B |
| Comparative example 29 | 0.80 | C | D |

The above-mentioned results show that the surface wearing and the image quality after repeated use can be improved by controlling the temperature of the image carrier (photoreceptor drum) within the optimal range. Contrary, any effect of the heating is not obtained when the photoreceptor having no surface protective layer.

An electrophotographic photoreceptor, in which the effects of the resin layer containing a siloxane resin having a cross-linking structure is maintained during a prolonged period of time, and which has a good charging property, a high sensitivity and a high image quality, and the charged potential thereof is stable in the course of use for a prolonged period of time, and to provide an image forming apparatus, an image forming method and a processing cartridge using the image carrier can be provided by the invention.

An electrophotographic image carrier which has a good charging ability, a high sensitivity and a high wearing resistivity, and the surface resistivity thereof is not lowered under a high humid condition, consequently the problem of image flowing is not occurred, and to provide an image forming apparatus, an image forming method and a processing cartridge each using the electrophotographic image carrier can be provided by the invention.

What is claimed is:

1. An electrophotographic image carrier comprising a substrate and a photoreceptor which comprises a photoreceptive layer and a resin layer provided on the photoreceptive layer, wherein the resin layer comprises a siloxane resin having a cross-linked structure, and the resin layer contains a hindered amine anti-oxidant compound.

2. The electrophotographic image carrier of claim 1 wherein the siloxane resin has a charge transportable structural unit.

3. The electrophotographic image carrier of claim 1 wherein the resin layer is a surface protective layer.

4. The electrophotographic image carrier of claim 1 wherein the siloxane resin is formed by reacting an organic silicon compound having a hydroxyl group or a hydrolyzable group with a compound having a charge transportable structural unit.

5. The electrophotographic image carrier of claim 4 wherein the compound having the charge transportable structural unit contains a hydroxy group.

6. The electrophotographic image carrier of claim 1 wherein the resin layer comprises a siloxane resin having a cross-linked structure represented by Formula 1, Formula 1

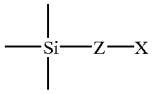

wherein X is a structural unit having charge transportability, and Z is an optional linking group having two or more valences.

7. The electrophotographic image carrier of claim 6 wherein Z in Formula 1 is a substituted or unsubstituted alkylene group or a substituted or unsubstituted arylene group.

8. The electrophotographic image carrier of claim 6 wherein Z in said Formula 1 represents O, S or NR, and wherein R represents H or a mono-valent organic group.

9. The electrophotographic image carrier of claim 1 wherein said resin layer further comprises a hindered phenol anti-oxidant compound.

10. The electrophotographic image carrier of claim 1 wherein said resin layer further comprises an organic phosphor anti-oxidant compound.

11. The electrophotographic image carrier of claim 1 wherein said resin layer further comprises a sulfur anti-oxidant compound.

12. The electrophotographic image carrier of claim 1 wherein the resin layer is the outermost layer.

13. The electrophotographic image carrier of claim 1 wherein the siloxane resin is formed by reacting an organic silicon compound having a hydroxyl group or a hydrolyzable group with colloidal silica.

14. An image forming apparatus comprises charging device, imagewise exposing device, developing device, transferring device, cleaning device and an electrophotographic image carrier of claim 1.

15. The image forming apparatus of claim 14, wherein said image carrier further comprises a heating device inside of the image carrier.

16. The image forming apparatus of claim 15, wherein the image carrier is heated by the heating device from inside of the image carrier.

17. A processing cartridge to be used for image forming process comprising charging, imagewise exposing, developing, transferring and cleaning, wherein the processing cartridge comprises an electrophotographic image carrier of claim 1 and at least one of a charging device, an image exposing device, a developing device, a transferring device and a cleaning device.

18. The processing cartridge of claim 17, wherein said image carrier further comprises a heating device located inside of the image carrier.

19. The processing cartridge of claim 18 wherein the photoreceptor is heated by the heating device from inside of the image carrier.

* * * * *